US009257225B2

(12) United States Patent
Li et al.

(10) Patent No.: US 9,257,225 B2
(45) Date of Patent: Feb. 9, 2016

(54) METHODS AND CONFIGURATIONS OF LC COMBINED TRANSFORMERS AND EFFECTIVE UTILIZATIONS OF CORES THEREIN

(76) Inventors: Chun Li, Toronto (CA); Jason (Jian Hao) Li, Toronto (CA); Ran Ran Li, Toronto (CA)

( * ) Notice: Subject to any disclaimer, the term of this patent is extended or adjusted under 35 U.S.C. 154(b) by 0 days.

(21) Appl. No.: 12/166,322

(22) Filed: Jul. 2, 2008

(65) Prior Publication Data

US 2010/0001822 A1 Jan. 7, 2010

(51) Int. Cl.

| | |
|---|---|
| ***H01F 21/04*** | (2006.01) |
| ***H01F 27/28*** | (2006.01) |
| ***H01F 21/02*** | (2006.01) |
| ***H01F 27/38*** | (2006.01) |
| *H01F 3/12* | (2006.01) |
| *H01F 38/16* | (2006.01) |

(52) U.S. Cl.
CPC ..... *H01F 27/385* (2013.01); *H01F 3/12* (2013.01); *H01F 38/16* (2013.01)

(58) Field of Classification Search
CPC ..... H01F 27/385; H01F 3/12; H01F 38/16
USPC ..... 336/105, 212, 145, 146, 182, 170
See application file for complete search history.

(56) References Cited

U.S. PATENT DOCUMENTS

| | | | | |
|---|---|---|---|---|
| 2,247,898 | A * | 7/1941 | Wheeler | 333/32 |
| 3,762,331 | A * | 10/1973 | Vlahos | 102/218 |
| 4,273,051 | A * | 6/1981 | Stratton | 102/202.2 |
| 4,551,681 | A * | 11/1985 | Seeley | 324/333 |
| 5,442,539 | A * | 8/1995 | Cuk et al. | 363/89 |
| 5,623,397 | A * | 4/1997 | Vinciarelli | 363/20 |
| 5,694,030 | A * | 12/1997 | Sato et al. | 323/282 |
| 5,757,233 | A * | 5/1998 | Kato et al. | 330/254 |
| 5,847,941 | A * | 12/1998 | Taguchi et al. | 363/21.03 |
| 5,959,413 | A * | 9/1999 | Komarek et al. | 315/306 |
| 6,018,219 | A * | 1/2000 | Komarek et al. | 315/194 |
| 6,317,337 | B1 * | 11/2001 | Yasumura | 363/21.04 |
| 6,408,008 | B1 * | 6/2002 | Komarek et al. | 370/458 |
| 6,639,984 | B1 * | 10/2003 | Taya et al. | 379/413 |

(Continued)

FOREIGN PATENT DOCUMENTS

JP 04-352304 A * 12/1992

*Primary Examiner* — Mangtin Lian

(57) ABSTRACT

The LC combined transformer is a combination of capacitors, inductors and an electrically-isolated mutual inductor, i.e. conventional transformer; which in principle is a unity-coupled mutual capacitor or a cascade connection of an ideal transformer and unity-coupled mutual capacitor(s). To improve the imperfections of widely-used transformers, by employing the simplest passive-circuit design to attain a perfectly-functional match between mutual capacitors and the mutual inductor, this invention achieves optimal features of current or/and voltage transformation, and introduces a new function of waveform conversion from square to quasi-sine. The ideal current transformer herein is suitable for sinusoidal current measurements, the ideal voltage transformer herein suitable for sinusoidal voltage measurements, and they also could be upgraded to ideal transformers for both current and voltage transformations. This transformer can be designed as power transferable as well as waveform convertible, applicable in power systems or power electronics. Herein also states the design approach of integrated inductor and mutual inductor, and the use of push-pull inductor, materials being fully utilized and sizes decreased.

4 Claims, 11 Drawing Sheets

(56) References Cited

U.S. PATENT DOCUMENTS 6,961,254 B2 * 11/2005 Tamura ..... 363/89
7,405,951 B2 * 7/2008 Tsuruya ..... 363/21.04
2007/0274105 A1 * 11/2007 Osaka ..... 363/21.02
2009/0290384 A1 * 11/2009 Jungreis ..... 363/17

* cited by examiner

Fig. 12 - Figures for *"6-4. Principle of the Mutual Capacitor"*:

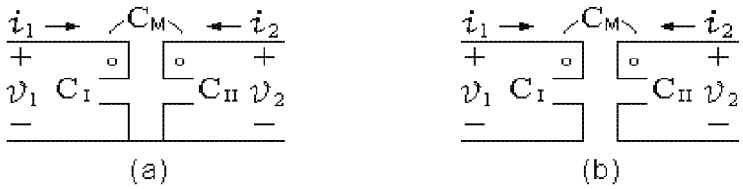

Fig.12-1 Schematic symbols for current type of mutual capacitors: (a) referenced in common; (b) referenced separately

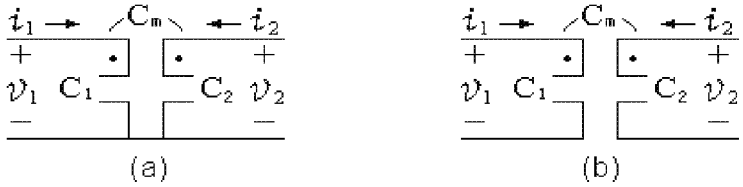

Fig.12-2 Schematic symbols for voltage type of mutual capacitors: (a) referenced in common; (b) referenced separately

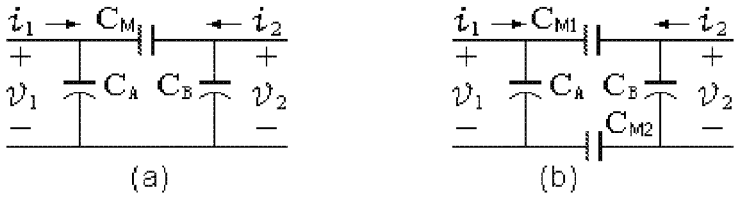

Fig.12-3 Circuit realizations for current type of mutual capacitor: (a) in *delta (Δ)* or *pi (π)* configuration and referenced in common; (b) equivalent from (a) but referenced separately.

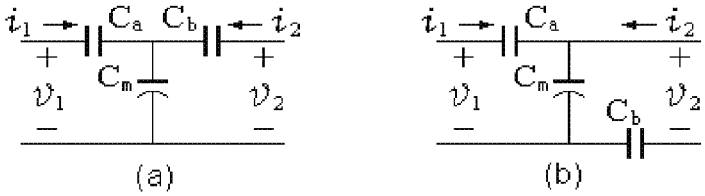

Fig.12-4 Circuit realizations for voltage type of mutual capacitor: (a) in *tee (T)* or *wye (Y)* configuration and referenced in common; (b) equivalent from (a) but referenced separately.

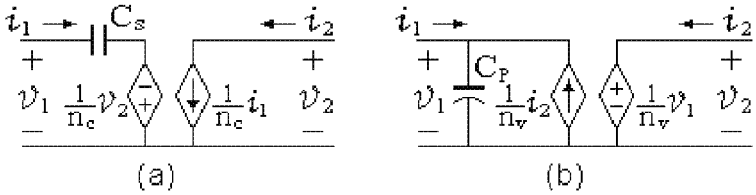

Fig.12-5 Equivalent circuits of unity-coupled mutual capacitors employing controlled sources: (a) current type; (b) voltage type

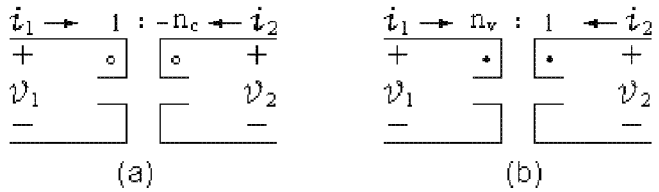
Fig.12-6 Symbols or models for ideal mutual capacitors: (a) current type; (b) voltage type
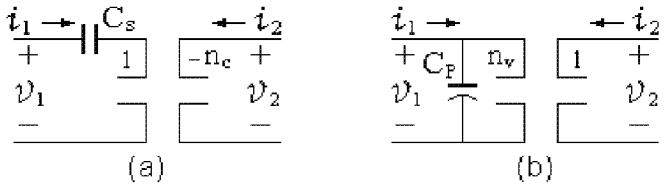
Fig.12-7 Equivalent circuits, employing ideal mutual capacitors, to clarify those in Fig.12-5 : (a) current type; (b) voltage type
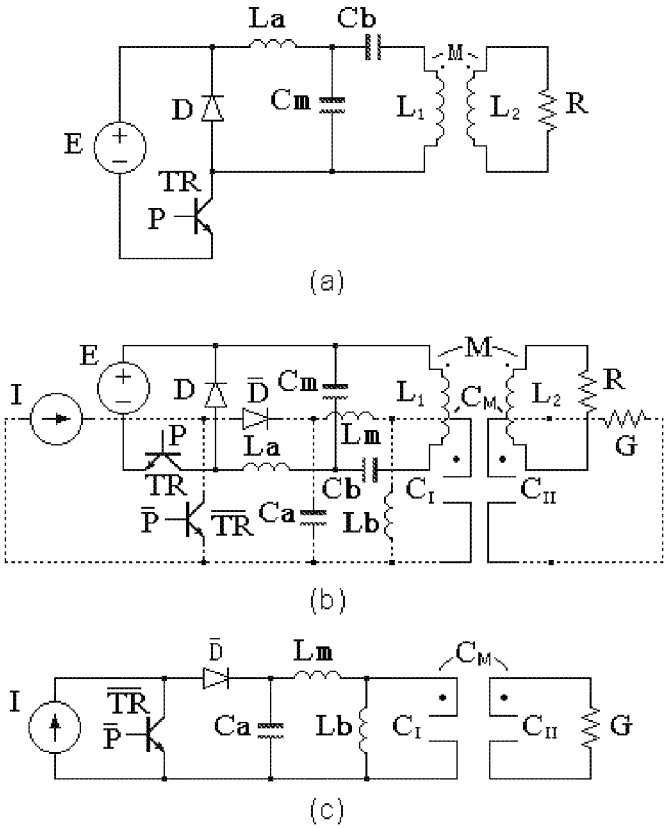
Fig.12-8 Example for making the dual of a circuit with a coupling component: (a) the primary; (b) how to make the dual; (c) the dual (Prior art)
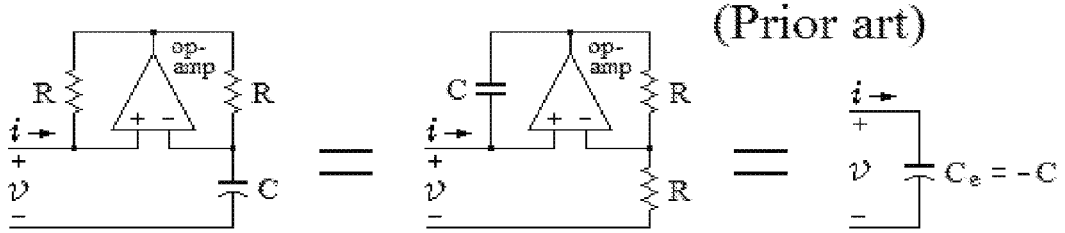
Fig. 12 – 9 Two realizations of Negative Impedance Converter (NIC) for negative capacitance and the equivalent circuit

METHODS AND CONFIGURATIONS OF LC COMBINED TRANSFORMERS AND EFFECTIVE UTILIZATIONS OF CORES THEREIN

FIELD OF THE INVENTION

This invention relates to an electric transformer, used for transferring electric signal or energy of periodical sine wave, i.e. ac, and proportionally altering its amplitude/magnitude of voltage or/and current. [Note: Exactly speaking, any electric signal comes with energy/power and vice versa, but in a sense of engineering they are two different performances of electricity.] And it specifically relates to a transformer, termed LC combined transformer, which is a combination of capacitors, inductors and also an electrically-isolated mutual inductor (namely, conventional transformer), and in principle is a unity-coupled mutual capacitor or a cascade connection of an ideal transformer and unity-coupled mutual capacitor(s).

BACKGROUND OF THE INVENTION

It is well known that, so far there has been only one species of ac electric transformer, i.e. the conventional voltage/current transformer, the prior art of this invention as well, being widely-used in electrical engineering. As a matter of fact, it is a mutual inductor, i.e. Tr in FIG. 1(*a*), with its coupling coefficient k less than but close to 1. In order to address this issue more clearly, for the time being, let's review its electric characteristic equations when neglecting power loss. If the port variables of a mutual inductor supposed as corresponding to those illustrated in FIG. 1(*a*), in electrical theory, its electrical characteristic equations in a sinusoidal steady-state circuit are presented as $$\begin{cases} V_1 = j\omega L_1 I_1 - j\omega M I_2 & (1) \\ V_2 = j\omega M I_1 - j\omega L_2 I_2 & (2) \end{cases}$$

where $L_1$ and $L_2$ respectively represent self-inductances of the primary winding and the secondary winding of the mutual inductor, M is the mutual inductance between them both; $\omega=2\pi f$. And attention must be paid to its coupling coefficient k and turns ratio n, which are defined as $$k = \frac{M}{\sqrt{L_1 L_2}} \tag{3}$$

$$n = \frac{N_1}{N_2} = \sqrt{\frac{L_1}{L_2}} \tag{4}$$

Obviously, the mutual inductor in FIG. 1(*a*) has an equivalent circuit schematically as in FIG. 1(*b*) [Note: FIG. 1(*c*) is also an equivalent circuit.], with its equations accordingly could be transformed as follows:

$$\begin{cases} V_a = V_1 - j\omega(1-k)L_1 I_1 = j\omega k L_1 I_1 - j\omega k\sqrt{L_1 L_2}\, I_2 = \sqrt{L_1}\left(j\omega k\sqrt{L_1}\, I_1 - j\omega k\sqrt{L_2}\, I_2\right) & (5) \\ V_b = V_2 + j\omega(1-k)L_2 I_2 = j\omega k\sqrt{L_1 L_2}\, I_1 - j\omega k L_2 I_2 = \sqrt{L_2}\left(j\omega k\sqrt{L_1}\, I_1 - j\omega k\sqrt{L_2}\, I_2\right) & (6) \end{cases}$$

-continued $$I_1 = \frac{V_a}{j\omega k L_1} + \sqrt{\frac{L_2}{L_1}}\, I_2 = \frac{V_a}{j\omega k L_1} + \frac{1}{n} I_2 = I_0 + \frac{1}{n} I_2 \tag{7}$$

In FIG. 1(*b*), enclosed in the broken-line box is an ideal transformer that has the simplest voltage and current relationships between ports as $V_a/V_b=n$, $I_1'/I_2=N_2/N_1=1/n$. Unfortunately for a practical transformer or mutual inductor, from FIG. 1(*b*) or equations above, it is easier understood that its voltage ratio is $$\frac{V_1}{V_2} \neq \frac{V_a}{V_b} = \frac{N_1}{N_2} = n,$$

and its current ratio is $$I_1 = I_0 + \frac{1}{n} I_2 \neq \frac{1}{n} I_2,\ (I_0 \neq 0).$$

This means that the conventional transformers, used either as a current transformer or as a voltage transformer or even as a power transformer, actually are all not precise in transformation of a current or of a voltage, as well as produce some inductive reactance capacity when transferring power since a conventional transformer or mutual inductor is both inductive and less-than-unity coupled, which is why errors exist in it inherently, due to the deficiency in its structure. Part of the errors originate from its leakage inductances $(1-k)L_1$ and $(1-k)L_2$ as well as magnetization inductance $kL_1$, so as called reactance error, or more exactly inductive reactance error [Note: Reactive error not only worsens the transforming precision but also produces reactive current of the supply so as to cause more power loss and higher cost for transmission line materials]. In addition, there exist the power-dissipation error, or resistance error, from its copper loss and iron loss; as well as non-linearity error from its non-linear performance of cores. Therefore, to obtain its required precision, the conventional transformer had to resort to lots of methods for improvements while designed.

Furthermore, in a power system, due to the varieties and complexity of the network loads, there disperse great numbers of high-order harmonics in the supply network. The high-order harmonics not only contribute to energy wastes but also endanger the safety of facilities and loads, causing misoperations and mishaps, and seriously interfering with signal transmissions. The conventional transformer is powerless against those harmonics except for its insulations being threatened and cores overheated. It would have been a dream that, provided that only a few of passive components are added, it could come true that the conventional transformer will become one both transferring power from input to output and also functioning as harmonics isolation from in between, i.e. a function of waveform conversion from square-wave to quasi-sine being added. It was just a matter of regret, being long expected but not realized yet, in the past.

SUMMARY OF THE INVENTION

Realizations of the LC combined transformer of this invention can be divided into three fundamental categories or types according to their functional focuses: current transformation category/type (ideal current transformer), voltage transformation category/type (ideal voltage transformer) and, voltage and current transformation category/type (ideal transformer); besides, though to some extent, they all can have the function of waveform conversion from square to quasi-sine. Aiming at the imperfections of the widely-used transformer in practical engineering, the invention presents some improvements in principle employing the easiest passive-circuit design approaches to realize the optimum characteristics of current or/and voltage transformations that eliminate the reactive error in principle, optimize structural parameters so as to reduce real-power loss error to minimum, as well as limit non-linear errors of both the inductors and the mutual inductor. To ensure the realizations of their best features, this invention also details the needed specific device selections, linearization processing of inductors, and the integration design approach for the coils and magnetic cores of the inductor and the mutual inductor, or the design approach of integrated inductor and mutual inductor, not only to achieve in compensation of the errors comprehensively, but also in cost savings with the goal of small devices. The ideal current transformer designed by this invention is suited for sinusoidal current measurements; the ideal voltage transformer suited for voltage measurements; and they both can be further updated into both voltage and current transformations, to accomplish power transferred plus voltage and current in-phased, decreasing the ac line reactive current. The invention also introduces into the designs the new characteristic of waveform conversion from square-wave to quasi-sine by which the transformers could be designed for both waveform conversion (or waveform isolation) and power delivery, suitable for applications in power systems, or power electronics, such as in dc transmission, the passive filtering of ac voltage or current, etc. Meanwhile, the use of push-pull inductor, as well as the technique of bi-periodically time-shared driving, is brought out, a solution to the problem of the core's unsymmetrical magnetization in double-ended converter under the alternately driving and also an improvement on the issue of cross-conductance of the driving switches.

BRIEF DESCRIPTION OF THE DRAWINGS

The following drawings, which form an important part of this specification, aid to elaborate the presented invention in details [Note: In this description and all drawings, a capital letter such as R or a capital letter plus lowercase letter(s) or cardinal number such as Ca or L1 respectively represents a circuit component or something in kind, and a capital letter such as R or a capital letter plus a subscript such as $C_a$ or $L_1$ represents corresponding physical quantity of the circuit components R, Ca or L1]:

FIGS. 12-1~12-9 are illustrated drawings for "6-4. *Principle of the Mutual Capacitor*".

DETAILED DESCRIPTION OF THE INVENTION

Figure 2:
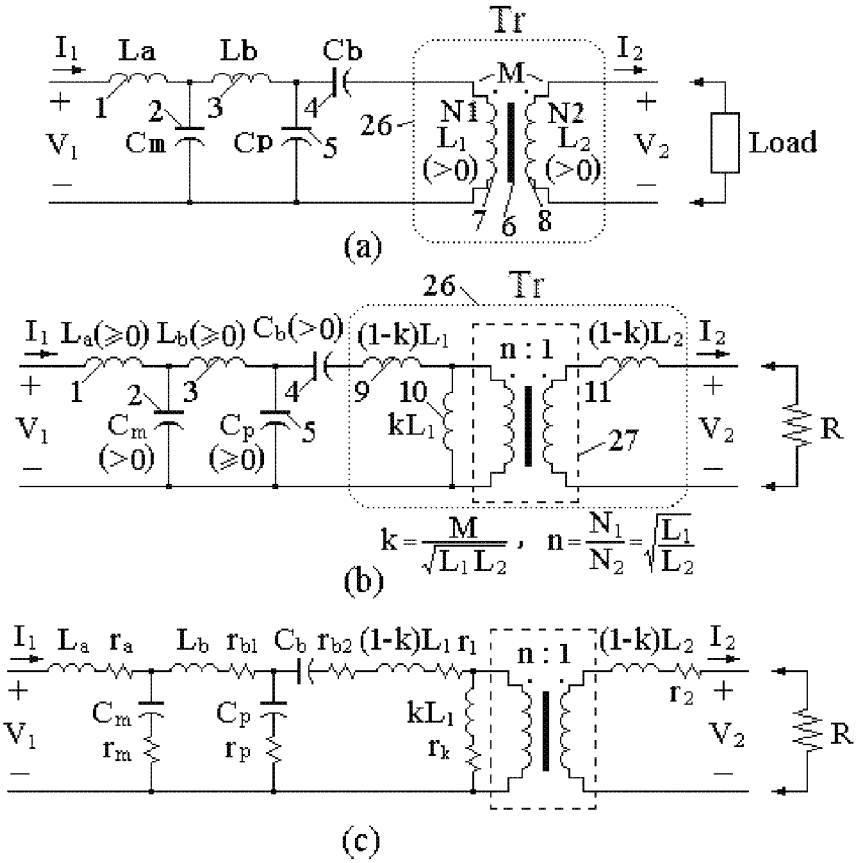
FIG. 2 is the diagram of general circuit arrangement of the LC combined transformer and those of its equivalent circuits for non-loss analysis and for loss analysis.

The general circuit configuration of the LC combined transformer is illustrated as in FIGS. 2(*a*) and (*b*), with the load not included. Circuit components 1 and 3 are inductors La and Lb, with inductance value>0 meaning positive, and the value=0 meaning short-circuited. Circuit components 2, 4 and 5 are capacitors Cm, Cb and Cp, with capacitance value>0 meaning positive (including $C \rightarrow +\infty$, short-circuited), and the value=0 meaning open-circuited. 6 is the core magnetic circuit of the mutual inductor, 7 is its primary winding N1 (with inductance $L_1>0$), and 8 is its secondary winding N2 (with inductance $L_2>0$) and, 6, 7 and 8 constitute a mutual inductor Tr or 26 (shown in the dotted-line box) or conventional transformer whose cores must be linearized. All the circuit components and the mutual inductor herein can be real devices, although their magnitudes or values may be worked out respectively by one or more components based on the principles of series-parallel connections, with their application equivalent for the definition herein, and with the corresponding power loss. Their electrically-interconnections are: taking one end of inductor 1 as the input terminal; the other end of inductor 1 and one end of capacitor 2 being together connected to one end of inductor 3; the other end of 3, one end of capacitor 5, jointly connected to one end of capacitor 4; and the other end of 4 connected to one end of the winding 7; and the other end of 7 connected to the other end of 5 and also to the other end of 2, before the joint taken as the common terminal; designating the input terminal and the common terminal as the input port of the LC combined transformer, designating the two terminals of winding 8 as its output port, and with the stipulation that input and output ports herein can be designated at will when needed. Where capacitor 5 should be may be as it is seen herein, or equivalently moved if necessary to parallel with the input or output port. And when capacitor 5 removed away or open-circuited, the position of capacitor 4 may be interchanged with that of inductor 3, or equivalently moved to series with the input or output port owing to doing so with the circuitry function unchanged except for a different parameter value. The mutual inductor 26 (or transformer) is a double-winding, and it can also be a multi-winding, as long as it can be theoretically converted to a double-winding mutual inductor and utilized within this invention. Any circuit designed out of the configurations of this invention must be working under the circumstance of a constant frequency ω (or f) of periodical sine wave unless in peculiar applications.

The technology scheme of this invention lies in that by utilization of the mutual inductor 26's leakage inductances 9 of $(1-k)L_1$ and 11 of $(1-k)L_2$ and the magnetization inductance 10 of $kL_1$, mated with externally connected capacitances or/and inductances, in accordance with the principle of the mutual capacitor [Note: As a lumped-constant circuit element, a mutual capacitor is a brand-new ac two-port network component whose performance is completely dual to the known mutual inductor. See "6-4. *Principle of the Mutual Capacitor*"], one or two cascaded unity-coupled mutual capacitors can be configured, with each functioning as ideal current or voltage transformer; and also cascading with the ideal transformer 27 which is peeled off the leakage and magnetization inductances 9, 10 and 11 from 26 and enclosed in the broken-line box; thus, an ideal current transformer, or an ideal voltage transformer, or an ideal transformer can eventually be achieved.

FIG. 2(*b*) is the schematic diagram of equivalent circuit for non-loss analysis of FIG. 2(*a*), and FIG. 2(*c*) is that for loss analysis. In order to make easier analysis and designs hereafter, let's assume that the LC combined transformer has a resistive load, R. The configuration of a specific circuit or variant of every type and mode of the LC combined transformer must be designed in accordance with its featured focuses or its main functions, while the main functions are to be determined by the employed LC unit system or module/block/subunit, named the mutual capacitor.

The LC combined transformer, according to its functional focus, can be divided into three fundamental categories or types: current transformation category/type (ideal current transformer), voltage transformation category/type (ideal voltage transformer), and voltage and current transformation category/type (ideal transformer); The first type has two circuit configurations of transformation-A type and transformation-B type, the latter two types include in-phase mode and anti-phase mode respectively, and the third type also includes transformation-A type and transformation-B type configurations.

1. Current Transformation Type LC Combined Transformer (Ideal Current Transformer)

The current transformation type of the LC combined transformer, or the ideal current transformer, has its main duties as performing sinusoidal current transformation, current monitoring and measuring or test for instruments, and it also can be designed for ac power delivery, as an ac constant-current generator, or as apparatus for current waveform conversion or isolation from square to quasi-sine as well.

1-1. Current Transformation-A Type LC Combined Transformer

Herein details the design of the current transformation-A type LC combined transformer with $V_2$ side in FIG. 2 taken as input port and $V_1$ side as output. Therefore, in FIG. 2, take inductor 1 and capacitor 4 short-circuited (namely, $L_a=r_a=0$, $C_b\rightarrow+\infty$, $r_b=0$), capacitor 5 open-circuited ($C_p=0$, $r_p\rightarrow+\infty$), to obtain the analysis circuit diagram as in FIG. 3.

Figure 3:
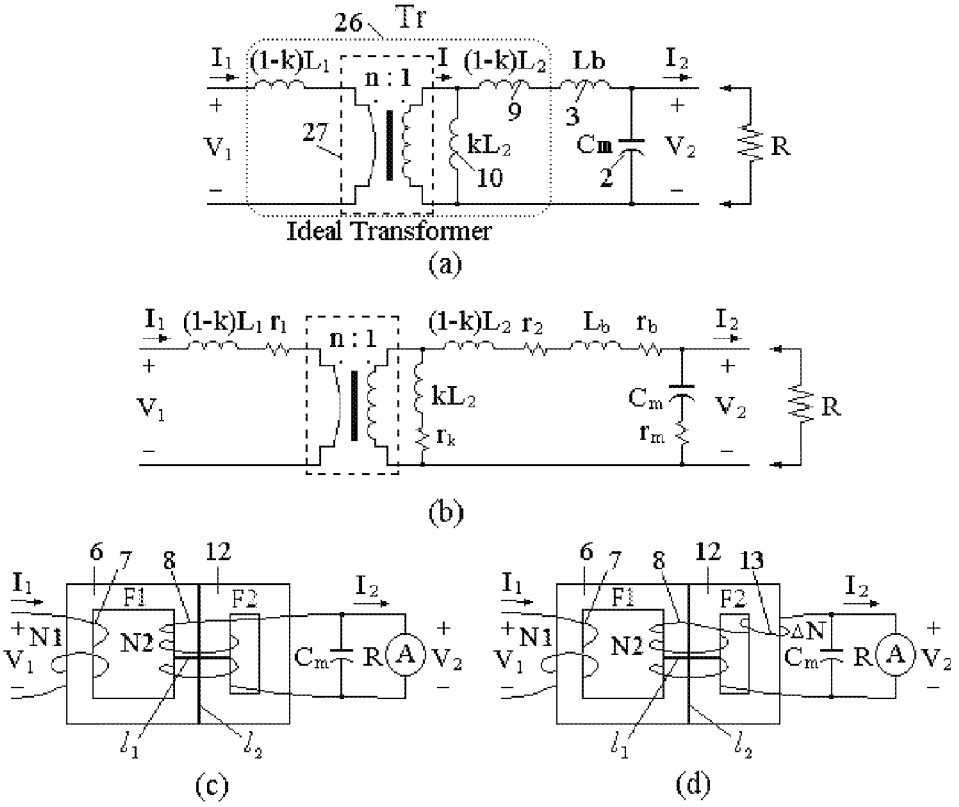
FIGS. 3 (*a*) and (*b*) are diagrams of the equivalent circuits for non-loss analysis and for loss analysis of current transformation-A type of the LC combined transformer (Ideal Current Transformer A); (*c*) and (*d*) are diagrams of the configurations employing the design approach of integrated inductor and mutual inductor.

In FIG. 3(*a*), the mutual-inductor 26's secondary magnetization inductance 10 and leakage inductance 9, inductor 3, and capacitor 2 constitute an LC subunit/subsystem, called delta (Δ) or pi (π) mutual capacitor. The current ratio of this mutual capacitor can be calculated as $$n_c = \frac{I}{I_2} = \frac{1}{k}\left[\left(1+\frac{L_b}{L_2}\right)+\frac{1-\omega^2 C_m(L_2+L_b)}{j\omega L_2}\cdot R\right] \tag{8}$$

If component parameters are set to obtain the condition $$\omega^2 C_m(L_2+L_b)=1 \tag{9}$$

the ratio will be $$n_c = \frac{I}{I_2} = \frac{1}{k}\left(1+\frac{L_b}{L_2}\right) \tag{10}$$

And including the ideal transformer 27, the current ratio of the entire circuit in FIG. 3(*a*) will be $$\frac{I_1}{I_2} = \frac{I_1}{I}\cdot\frac{I}{I_2} = \frac{1}{n}\cdot n_c = \frac{1}{nk}\left(1+\frac{L_b}{L_2}\right) \tag{11}$$

This result indicates that the circuit in FIG. 3, when the condition/prerequisite Eq. (9) being satisfied, is an ideal transformer of current transformation, called transformation-A ideal current transformer or ideal current transformer A, because it performs a current transformation at a fixed ratio of $(I_1/I_2)$, which is independent of both the working frequency ω and the load R. And the ratio is determined only by the selected values of the mutual inductor's turns ratio $$\left(n = \frac{N_1}{N_2} = \sqrt{\frac{L_1}{L_2}}\right),$$

the coupling coefficient $$\left(k = \frac{M}{\sqrt{L_1 L_2}}\right),$$

the self-inductance $L_2$, and the series inductance $L_b$.

But, all the above conclusions are obtained in an ideal situation. As a matter of fact, the frequency of steady-state sinusoidal current is slightly undulate (for 60 Hz or 50 Hz line frequency has a relative error $$\left|\frac{\Delta f}{f}\right| = \left|\frac{\Delta\omega}{\omega}\right| \leq 1\%);$$

capacitors have their capacitance values changeable with the waving ambient temperature; iron-cored inductors are of such a non-linearity that their inductance values are changeable with magnitudes of the current flowing through the coil windings therein (i.e. with the changes of operating points); in addition, wires, cores as well as capacitors in reality are power-dissipated (see FIG. 3(*b*)); which all would deviate the current ratio from Eq. (11). Here come the errors theoretically derived as follows:

The relative error of the current ratio on frequency change is $$\left|\frac{\Delta n_c}{n_c}\right|_\omega \approx 2\omega C_m R \cdot \left|\frac{\Delta\omega}{\omega}\right| \tag{12}$$

The relative error of the current ratio on capacitance change is $$\left|\frac{\Delta n_c}{n_c}\right|_C \approx \omega C_m R \cdot \left|\frac{\Delta C}{C}\right| \tag{13}$$

The relative error of the current ratio on relative permeability change of the core material is $$\left|\frac{\Delta n_c}{n_c}\right|_\mu \approx \frac{\alpha\omega C_m R}{\alpha + \mu_r} \cdot \left|\frac{\Delta\mu_r}{\mu_r}\right| \tag{14}$$

where, $\alpha = l_F/l_g$ is the ratio of the core magnetic circuit length to the air-gap length; $\mu_r$ is the relative permeability of the inductors' core material. Moreover, the prerequisite for satisfying this equation is that inductances of $L_2$ and $L_b$ are made of the same core material and of the same $\alpha$ value.

The relative error of the current ratio on the devices' power-loss from FIG. 3(*b*) is $$\left|\frac{\Delta n_c}{n_c}\right|_r \approx (r_2 + r_b + r_k + r_m)(\omega C_m)^2 R \tag{15}$$

The prerequisite for satisfying this equation is that quality factors of the inductors of $L_2$ and $L_b$ are equal and far greater than one, i.e.

$$\frac{\omega L_2}{r_2 + r_k} = \frac{\omega L_b}{r_b} >> 1;$$

and also that the loss tangent of capacitor Cm should be very small, or $\omega C_m r_m = \text{tg}\ \delta \rightarrow 0$.

Design Key Points [Note: Refer to "6-1. *Design Instructions of the LC Combined Transformer and General Rules for Its Device Selections*"]: Attentions should be paid to error equations (12)~(15) on that ($\omega\ C_m R$) is a key parameter expression for designing errors of the mutual capacitor, called error-designed parameter expression of the mutual capacitor; if it is small the error will be small; meanwhile, Eq. (9) shows that the inductance value of ($L_2$+$L_b$) will be large so as to waste materials and increase sizes. Therefore, proper compromise will be needed in practical designing.

Device Selections: The criterion of device selections for transformation-A ideal current transformer is to meet the requirements of above theoretical designing as far as possible, improving the inherent features that properties of devices vary along with ambient or/and working conditions in materials, physical structures, as well as manufacture methods etc, namely increasing the linearity, and decreasing devices' power dissipation or reducing influence of devices' power-loss over operation.

Device selection of capacitor Cm includes that a proper capacitance value should be determined according to the measuring accuracy or error request designed from (12)~(15), and the right product be chosen according to the requests of, the range of ambient temperature change, working frequency, voltage grade, value precision grade and dielectric loss angle etc. In this case, due to Cm in parallel with the low-valued resistive load R (ammeter A) (see FIG. 3(*c*)), the objective of voltage grade is apt to be obtained, and the dielectric loss angle tangent, tg $\delta < 10^{-3}$, of non-polar capacitors of most modern manufacturers is good enough for this application; then by Eq. (13), according to the determined value and the range of ambient temperature change, select the capacitor with appropriate dielectric material.

Parameter's values of the inductor and the mutual inductor, such as Lb, $L_2$, n and k are to be determined from Eqs. (9)~(11), where the value k must be pre-determined accurately through experiment so as to reduce blindness in the follow-up designing.

Device selections of the mutual inductor and the series inductor is a key step for designing in this case, including determination of the coil copper wires, core materials, physical structures and their production methods. The $L_1$ and $L_2$ of the mutual inductor must be of an identical core material with low-loss and high saturation magnetic flux density to that of the inductor Lb, together with precise calculation of the amount of copper and core to be used, managing to ensure the quality factors of $L_2$ and Lb to be equal and far greater than one, or $$\frac{\omega L_2}{r_2 + r_k} = \frac{\omega L_b}{r_b} >> 1.$$

Both the series inductor 3 and the mutual inductor 26 must be of a structure of core plus air-gap, which is referred to as linerization processing of inductors/mutual-inductors [Note: Refer to "6-2. *Formulas for Linerization Processing of Inductors/Mutual-Inductors*"], for air-gapped inductor is calculated as $$L_2 = \frac{\mu_0 N_2^2 S_2}{l_{g2} + l_{F2}/\mu_r} = \frac{\mu_0 N_2^2 S_2}{l_{g2}[1 + (l_{F2}/l_{g2})/\mu_r]} = \frac{\mu_0 N_2^2 S_2}{l_{g2}[1 + \alpha_2/\mu_r]} = \frac{\mu_0 N_2^2 S_2}{l_{F2}[(l_{g2}/l_{F2}) + 1/\mu_r]} = \frac{\mu_0 N_2^2 S_2}{l_{F2}[1/\alpha_2 + 1/\mu_r]}$$

$$L_b = \frac{\mu_0 N_b^2 S_b}{l_{gb} + l_{Fb}/\mu_r} = \frac{\mu_0 N_b^2 S_b}{l_{gb}[1 + (l_{Fb}/l_{gb})/\mu_r]} = \frac{\mu_0 N_b^2 S_b}{l_{gb}[1 + \alpha_b/\mu_r]} = \frac{\mu_0 N_b^2 S_b}{l_{Fb}[(l_{gb}/l_{Fb}) + 1/\mu_r]} = \frac{\mu_0 N_b^2 S_b}{l_{F2}[1/\alpha_b + 1/\mu_r]}$$

where, $l_F$ and $l_g$ represent the core length and air-gap length respectively, and $\alpha_i = l_{Fi}/l_{gi}$ (i=2, b); $N_i$ is coil winding turns number; $S_i$ is core cross-sectional area. Assuming $\alpha = \alpha_2 = l_{F2}/l_{g2} = l_{Fb}/l_{gb} = \alpha_b$, and substitute above two formulas of $L_2$ and $L_b$ into Eq. (11) as $$\frac{I_1}{I_2} = \frac{1}{nk}\left(1 + \frac{L_b}{L_2}\right) = \frac{1}{nk}\left[1 + \frac{l_{g2}}{l_{gb}} \cdot \frac{S_b}{S_2}\left(\frac{N_b}{N_2}\right)^2\right] = \frac{1}{nk}\left[1 + \frac{l_{F2}}{l_{Fb}} \cdot \frac{S_b}{S_2}\left(\frac{N_b}{N_2}\right)^2\right] \tag{16}$$

Eq. (16) indicates that the current ratio of this LC combined transformer illustrated in FIG. 3 is absolutely determined by the structural parameters of $L_1$ and $L_2$ of the mutual inductor 26, and of Lb of the series inductor 3, theoretically independent of the value $\mu_r$ of the core material; which is because the introduction of the air-gap, i.e. the linerization processing of inductors, causes the inductances much more stable, and also because of a principle of cancellation of similarity employed during the design and coil winding of inductors. The relative error of the final current ratio of the entire current transformer influenced by the change of relative permeability of core is obtained from Eq. (14).

1-2. Design Approach of Integrated Inductor and Mutual Inductor

FIGS. 3(*c*) and (*d*) are diagrams of the current transformation-A type LC combined transformer employing the design approach of integrated inductor and mutual inductor.

The integrated inductor and mutual inductor includes: the mutual inductor's core magnetic circuit 6, the series inductor's core magnetic circuit 12, the mutual inductor's primary winding 7, the two-in-one common coil winding 8 which serves as both the mutual inductor's secondary winding and also the series inductor's winding, as well as the auxiliary winding 13. The magnetic circuits of the integrated inductor & mutual inductor may be made from any core material, with any possible shape and any cross-sectional areas, and also may be unequal in length to each other; but the ratios of both of the core magnetic circuit length to the air-gap length respectively, should be equal or approximately equal. The mutual inductor's turns ratio, coupling coefficient, primary self-inductance, secondary self-inductance, and all the current and power relationships are still the same as those of its original mutual inductor, but its output total inductance should be determined, under a condition of the magnetic circuits being in a qualified linearity, by the sum of the mutual inductor's secondary self-inductance determined as a conventional mutual inductor plus the inductance determined by windings 8 and 13, and core 12 all together. In addition, to ensure the magnetic circuits of a sound linearity, gaps or clearances $l_1$ and $l_2$ may be set as shown in FIG. 3(*c*).

The so-called integration design of the inductor and mutual inductor is actually to have the cores of the series inductor and the mutual inductor integrated together, and also to have their coil windings integrated together, in a result that they look like only one mutual inductor with a function of the mutual inductor plus the series inductor. Assuming $N_2 = N_b$ in Eq. (16), that is $$\frac{I_1}{I_2} = \frac{1}{nk}\left(1 + \frac{L_b}{L_2}\right) = \frac{1}{nk}\left[1 + \frac{l_{g2}}{l_{gb}} \cdot \frac{S_b}{S_2}\right] = \frac{1}{nk}\left[1 + \frac{l_{F2}}{l_{Fb}} \cdot \frac{S_b}{S_2}\right] \tag{16a}$$

which is the equation of the current ratio of the current transformation-A type LC combined transformer employing the design approach of integrated inductor & mutual inductor. From this equation, only k could be adjusted when n ($=N_1/N_2$), $l_F$, $l_g$ and S are made fixed. However, the variation of k means changing the air-gap length, also meaning the condition of Eq. (9) spoiled. Now, assuming $N_b = N_2 + \Delta N$ again and substituting it into Eq. (16), we have $$\frac{I_1}{I_2} = \frac{1}{nk}\left(1 + \frac{L_b}{L_2}\right) = \frac{1}{nk}\left[1 + \frac{l_{g2}}{l_{gb}} \cdot \frac{S_b}{S_2}\left(1 + \frac{\Delta N}{N_2}\right)\right] = \frac{1}{nk}\left[1 + \frac{l_{F2}}{l_{Fb}} \cdot \frac{S_b}{S_2}\left(1 + \frac{\Delta N}{N_2}\right)\right] \tag{16b}$$

As seen in this equation, the variation of ΔN, i.e. changing turns number of the auxiliary winding, changes only the inductance of $L_b$, by which comes true the needed micro-adjustment, with the layout of the coil windings as in FIG. 3(*d*).

Like the design of every other product, the design of this product has to be improved through repeated experiments so finally to be as expected. Moreover, a suggestion is made, if possible, that the same kind of magnetic powder core material should be employed for the two pairs of cores of F1 and F2 illustrated as in FIG. 3(*c*) or (*d*); whose advantage is that it's much easier to have an equal a value for both.

It will save materials to design an LC combined transformer by employing the integration design of inductor and mutual inductor (a coil winding of $L_b$ saved) so that the total size decreases because the air-gapped cores set the current transformer free from heavy burden of the balance of the magnetic potentials or ampere-turns, and meanwhile the requirements of the window areas of the cores and of the insulation grades decrease accordingly. However, these advantages can be brought into play only at high-current measurements because a fixed LC value must be set, by Eq. (9), for the current transformation-A type LC combined transformer. It is also easy to notice from Eqs. (10) and (11) that the current transformation-A type LC combined transformer, as a matter of fact, performs two current transformations that 1/n is the first current transformation ratio, namely the current ratio of the conventional current transformer, and the second is that of the mutual capacitor which is determined by Eq. (10), so that a very high rating of current transformation ratio could be achieved.

In the integrated inductor and mutual inductor (FIG. 3(*c*) or (*d*)), the function of a mutual inductor occurs between coil windings N1 and N2 while N2 on its own functions as two inductances in series as $$L_{Total} = L_{F1} + L_{F2} = \frac{\mu_0 N_2^2 S_{F1}}{l_{g1} l_{F1}/\mu_r} + \frac{\mu_0 N_b^2 S_{F2}}{l_{g2} l_{F2}/\mu_r} \tag{17}$$

where, meanings of the symbols are the same as previous, and the subscripts in accordance with the core number F1 and F2 [Note: this equation is obtained under the condition of a good linearity]. And proof of this equation omitted for easiness.

1-3. Current Transformation-B Type LC Combined Transformer

The circuit design of the current transformation-B type LC combined transformer is also presented as the formation with $V_2$ side in FIG. 2 as input port and $V_1$ side as output. In FIG. 2, make inductors 1 and 3 short-circuited (namely, $L_a=r_a=0$, $L_b=r_{b1}=0$), capacitor 5 open-circuited ($C_p=0$, $r_p\rightarrow+\infty$), to obtain the analysis circuit diagram as in FIG. 4.

Figure 4:
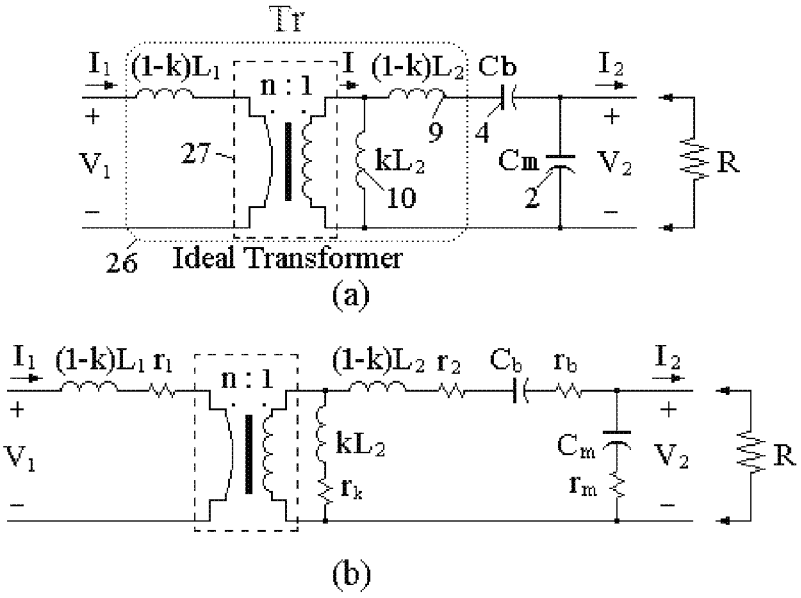
FIGS. 4 (*a*) and (*b*) are diagrams of the equivalent circuits for non-loss analysis and for loss analysis of current transformation-B type of the LC combined transformer (Ideal Current Transformer B).

In FIG. 4(*a*), the mutual inductor 26's secondary magnetization inductance 10 and leakage inductance 9, capacitors 2 and 4 constitute an LC subunit/subsystem, called delta (Δ) or pi (π) mutual capacitor. Including the ideal transformer, the current ratio of this mutual capacitor can be calculated as $$n_c = \frac{I}{I_2} = \frac{1}{k}\left\{\left(1 - \frac{1}{\omega^2 L_2 C_b}\right) + j\left[\omega C_m - \frac{1}{\omega L_2}\left(1 + \frac{C_m}{C_b}\right)\right]R\right\} \tag{18}$$

If component parameters are set to obtain the condition $$\omega^2 L_2 (C_b \perp C_m) = \omega^2 L_2 \left(\frac{C_b C_m}{C_b + C_m}\right) = 1 \tag{19}$$

then $$n_c = \frac{I_1}{I_2} = \frac{1}{k}\left(1 - \frac{1}{\omega^2 L_2 C_b}\right) = \frac{1}{\omega^2 k L_2 C_m} = \frac{C_b}{k(C_b + C_m)} \tag{20}$$

And notice that $n_c<1$ in most cases. Thus the current ratio of the entire circuit in FIG. 4(*a*) will be $$\frac{I_1}{I_2} = \frac{I_1}{I} \cdot \frac{I}{I_2} = \frac{1}{n} \cdot n_c = \frac{C_b}{nk(C_b + C_m)} \tag{21}$$

And this result denotes that the circuit in FIG. 4, when the condition or prerequisite Eq. (19) is satisfied, is also an ideal transformer of current transformation, called the transformation-B ideal current transformer or ideal current transformer B, because it performs a current transformation at a fixed ratio of $(I_1/I_2)$, which is independent of both the working frequency ω and the load R. And the ratio is determined only by the selected values of the mutual inductor's turns ratio ($n=N_1/N_2=\sqrt{L_1/L_2}$), the coupling coefficient $$\left(k = \frac{M}{\sqrt{L_1 L_2}}\right),$$

the series capacitance $C_b$, and the parallel capacitance $C_m$.

Here give the errors theoretically derived as follows:

The relative error of the current ratio on frequency change is $$\left|\frac{\Delta n_c}{n_c}\right|_\omega \approx \sqrt{1 + [\omega(C_b + C_m)R]^2} \cdot 2\frac{C_m}{C_b} \cdot \left|\frac{\Delta\omega}{\omega}\right| \tag{22}$$

The relative error of the current ratio on capacitance change is $$\left|\frac{\Delta n_c}{n_c}\right|_C \approx \sqrt{1 + [\omega(C_b + C_m)R]^2} \cdot \frac{C_m}{C_b} \cdot \left|\frac{\Delta C}{C}\right| \tag{23}$$

The relative error of the current ratio on relative permeability change of the core material is $$\left|\frac{\Delta n_c}{n_c}\right|_\mu \approx \sqrt{1 + [\omega(C_b + C_m)R]^2} \cdot \frac{C_m}{C_b} \cdot \frac{\alpha}{\alpha + \mu_r}\left|\frac{\Delta\mu_r}{\mu_r}\right| \tag{24}$$

where, $\alpha=l_F/l_g$ is the ratio of the core magnetic circuit length to the air-gap magnetic circuit length; $\mu_r$ is the relative permeability of the inductors' core material. Moreover, the prerequisite for satisfying this equation is that equivalent inductances of $(1-k)L_2$ and $kL_2$ are of the same α value. The relative error of the current ratio on the devices' power-loss obtained from FIG. 4(*b*) is $$\left|\frac{\Delta n_c}{n_c}\right|_r \approx (r_2 + r_b + r_k + r_m)(\omega C_m)^2 R \tag{25}$$

The prerequisite for satisfying this equation is that quality factor of the inductor $L_2$ is far greater than one, i.e.

$$\frac{\omega L_2}{r_2 + r_k} >> 1;$$

and also that the loss tangent of capacitors Cb and Cm should be very small, that is $\omega C_b r_b = \omega C_m r_m = \text{tg}\ \delta \rightarrow 0$.

Design Key Points [Note: See "6-1. *Design Instructions of the LC Combined Transformer and General Rules for Its Device Selections*"]: Attentions should be paid to error equations (22)~(25) on that $$\left(\sqrt{1+[\omega(C_b+C_m)R]^2}\cdot\frac{C_m}{C_b}\right)$$

is the error-designed parameter expression of the mutual capacitor; when the values of $$(C_b+C_m)\text{ and }\frac{C_m}{C_b}$$

set small the error will be very small; meanwhile, Eq. (19) shows that the inductance of $L_2$ will be large so as to waste materials and increase the sizes. Therefore, proper compromise will be needed in practical designing.

Device Selections: Device selections of capacitors 4 or Cb and 2 or Cm include proper determination of their capacitance values on designed measuring accuracy or error requirements, choosing the right products according to the requests of, the range of ambient temperature change, working frequency, voltage grade, value precision grade and dielectric loss angle etc, and characteristics of both capacitances changing with the environment expected as keeping in accordance. Requirements for the mutual inductor 26 is of a precise k value, $L_2$ of a good linearity, and low power loss.

2. Voltage Transformation Type LC Combined Transformer (Ideal Voltage Transformer)

The voltage transformation type of the LC combined transformer, or the ideal voltage transformer, has its main uses of performing sinusoidal voltage transformation, voltage monitoring and measuring/test for instruments; and it also can be designed for ac power delivery, or as an apparatus for voltage waveform conversion or isolation from square to quasi-sine as well. The voltage transformation type of the LC combined transformer includes two realizations of circuit configurations of in-phase mode and anti-phase mode.

2-1. In-Phase Mode of the Voltage Transformation Type LC Combined Transformer

Figure 5:
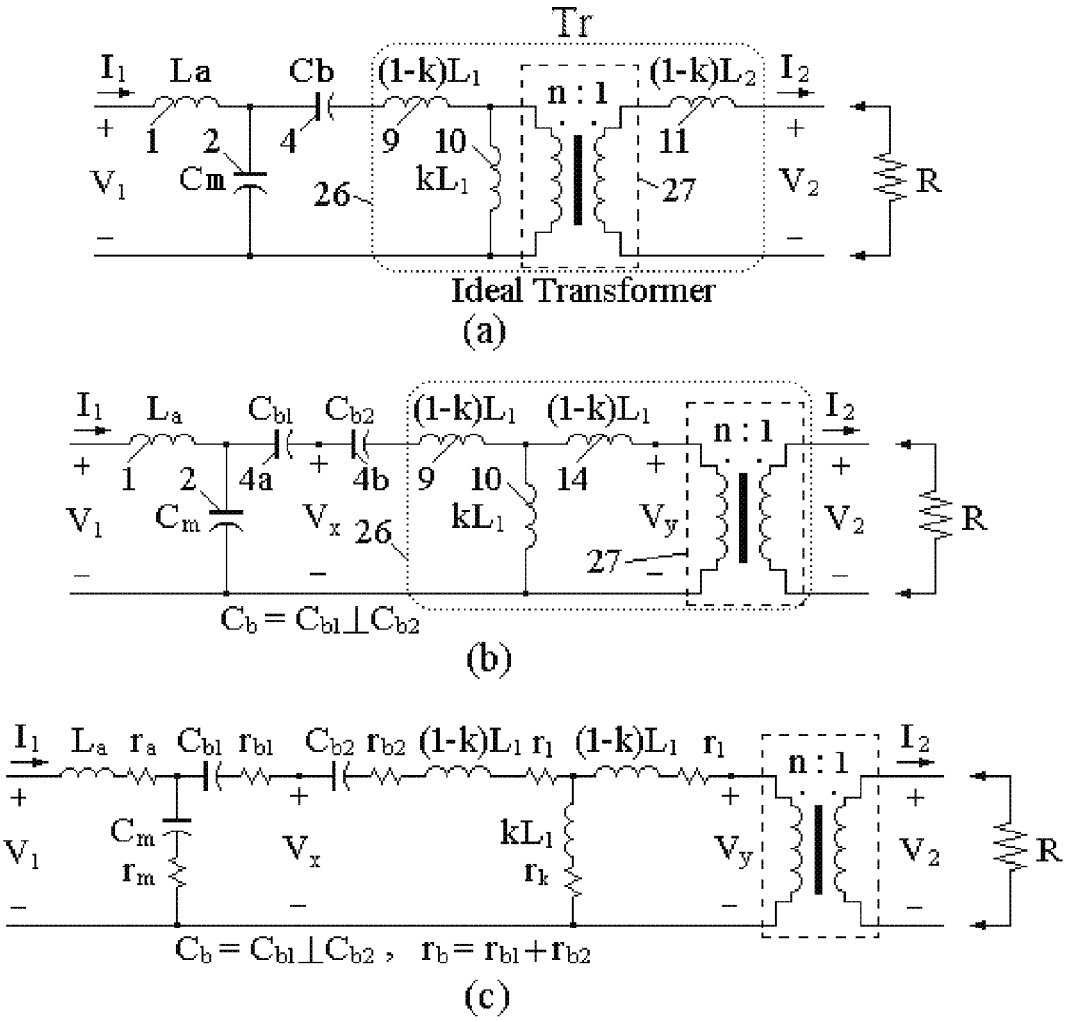
FIG. 5 has diagrams of the equivalent circuits for non-loss analysis and for loss analysis of the in-phase mode of voltage transformation type of the LC combined transformer.

In the circuit diagram of FIG. 2, let inductor 3 short-circuited (i.e. $L_b=r_{b1}=0$), capacitor 5 open-circuited (i.e. $C_p=0$, $r_p\rightarrow+\infty$) to obtain the in-phase mode of the voltage transformation type LC combined transformer illustrated in FIG. 5(*a*). In order to analyze it, let's split capacitor 4 into two, $$C_b=C_{b1}+C_{b1}=\frac{C_{b1}C_{b2}}{C_{b1}+C_{b2}}\Big),$$

i.e. 4*a* and 4*b* (or, $C_b$ splited into $C_{b1}$ and $C_{b1}$ and equivalently reflect the leakage inductance 11 from the right side of the mutual inductor onto the left side as inductance 14, shown as in FIG. 5(*b*); where inductor 1, capacitors 2 and 4*a* constitute the first LC subunit/subsystem, called tee (T) or wye (Y) mutual capacitor; capacitance 4*b*, two leakage inductances 9 and 14 of the mutual inductor 26, and its magnetization inductance 10 constitute the second wye (Y) mutual capacitor; and the third part is the ideal transformer 27.

For the first tee (T) mutual capacitor, assuming that it has an equivalent load of resistance $R_1$, its voltage ratio will be $$n_{v1}=\frac{V_1}{V_x}=\left(1-\omega^2L_aC_m\right)+\frac{1}{j\omega C_{b1}}[1-\omega^2L_a(C_{b1}+C_m)]\frac{1}{R_1} \tag{26}$$

If setting the component parameters to obtain the condition $$\omega^2L_a(C_{b1}+C_m)=1 \tag{27}$$

we have $$n_{v1}=1-\omega^2L_aC_m=\frac{C_{b1}}{C_{b1}+C_m} \tag{28}$$

Then, the relative error of the voltage ratio on frequency change is $$\left|\frac{\Delta n_{v1}}{n_{v1}}\right|_\omega\approx\sqrt{1+\left(\frac{1}{\omega n_{v1}C_mR_1}\right)^2}\cdot 2\left|\left(\frac{1}{n_{v1}}-1\right)\frac{\Delta\omega}{\omega}\right| \tag{29}$$

The relative error of the voltage ratio on capacitance change is $$\left|\frac{\Delta n_{v1}}{n_{v1}}\right|_C\approx\sqrt{1+\left(\frac{1}{\omega n_{v1}C_mR_1}\right)^2}\cdot\left|\left(\frac{1}{n_{v1}}-1\right)\frac{\Delta C_m}{C_m}\right|;\quad\left(\text{when }\left|\frac{\Delta C_{b1}}{C_{b1}}\right|=\left|\frac{\Delta C_m}{C_m}\right|\right) \tag{30}$$

The relative error of the voltage ratio on relative permeability change of the core material is $$\left|\frac{\Delta n_{v1}}{n_{v1}}\right|_\mu\approx\sqrt{1+\left(\frac{1}{\omega n_{v1}C_mR_1}\right)^2}\cdot\frac{\alpha}{(\alpha+\mu_r)}\left|\left(\frac{1}{n_{v1}}-1\right)\frac{\Delta\mu_r}{\mu_r}\right| \tag{31}$$

where, $\alpha=l_F/l_g$ is the ratio of the core magnetic circuit length to the air-gap magnetic circuit length; $\mu_r$ is the relative permeability of the inductors' core material.

The relative error of the current ratio on the devices' power-loss obtained from FIG. 5(*c*) is $$\left|\frac{\Delta n_{v1}}{n_{v1}}\right|_r\approx\frac{r_a}{n_{v1}^2R_1} \tag{32}$$

The prerequisite for satisfying Eq. (32) is that the loss angle tangents of capacitors Cb1 and Cm are equal or approximately equal, that is $\text{tg}\,\delta_{b1}=\omega C_{b1}r_{b1}\approx\omega C_mr_m=\text{tg}\,\delta_m$, as well as $\text{tg}\,\delta\rightarrow0$. Also, it is noted that, when output power of this mutual capacitor is P, $$R_1=\frac{V_x^2}{P}=\frac{V_1^2}{n_{v1}^2P} \tag{33}$$

Design Key Points [Note: See "6-1. *Design Instructions of the LC Combined Transformer and General Rules for Its Device Selections*"]: From the error equations, $$\sqrt{1+\left(\frac{1}{\omega n_{v1}C_mR_1}\right)^2}\cdot\left(\frac{1}{n_{v1}}-1\right)$$

will be found out as the error-designed parameter expression of this mutual capacitor; if the value of ($\omega C_m R_1$) set large the error will be small, but its capacity of load carrying will be limited; to improve which, there exist some ways, i.e. increasing the value(s) of $C_m$ or/and $\omega$.

Device Selections: Device selections of capacitors 2 and 4 require the value precision grade and their temperature coefficient taken as high as possible based on the requirements of design. The temperature coefficients of $C_{b1}$ and $C_m$ are needed to be in accordance, and the loss angle tangents should be equal or approximately equal, that is tg $\delta_{b1}=\omega C_{b1} r_{b1} \approx \omega C_m r_m = \text{tg}\ \delta_m$, as well as tg $\delta \rightarrow 0$. Meanwhile, the maximum voltages on the capacitors $C_{b1}$ and $C_m$ are calculated as the following equations (assuming the mutual capacitor's maximum load as $R_{1m}$).

$$U_{b1max} \geq \frac{2V_x}{\omega C_{b1} R_{1m}} = \frac{2V}{\omega C_{b1} n_{v1} R_{1m}} = \frac{2V_1(1-n_{v1})}{\omega C_m n_{v1}^2 R_{1m}} \tag{34}$$

$$U_{mmax} \geq 2V_x\sqrt{1+\left(\frac{1}{\omega C_{b1} R_{1m}}\right)^2} = \frac{2V_1}{n_{v1}}\sqrt{1+\left(\frac{1}{\omega C_{b1} R_{1m}}\right)^2} = \frac{2V_1}{n_{v1}}\sqrt{1+\left(\frac{1-n_{v1}}{\omega C_m n_{v1} R_{1m}}\right)^2} \tag{35}$$

The core of inductor 1 or $L_a$ should be selected of a low-loss core material, with its magnetic circuit length ratio $\alpha$ of the iron core to the air gap chosen by Eq. (31) to meet the design requirements and also according to the material specifications.

Assume $R_2$ as the equivalent load of resistance for the second mutual capacitor; its voltage ratio is $$n_{v2} = \frac{V_x}{V_y} = \frac{1}{k}\left[\left(1-\frac{1}{\omega^2 L_1 C_{b2}}\right) + \frac{1-\omega^2(1-k^2)L_1 C_{b2}}{j\omega C_{b2}\cdot R_2}\right] \tag{36}$$

If setting the component parameters to obtain the condition $$\omega^2(1-k^2)L_1 C_{b2}=1 \tag{37}$$

we have $$n_{v2} = \frac{V_x}{V_y} = \frac{1}{k}\left(1-\frac{1}{\omega^2 L_1 C_{b2}}\right) = k \tag{38}$$

The relative error of the voltage ratio on frequency change is $$\left|\frac{\Delta n_{v2}}{n_{v2}}\right|_\omega \approx \sqrt{1+\left(\frac{\omega L_1}{R_2}\right)^2}\cdot 2\left(\frac{1}{k^2}-1\right)\left|\frac{\Delta\omega}{\omega}\right| \tag{39}$$

The relative error of the voltage ratio on capacitance change is $$\left|\frac{\Delta n_{v2}}{n_{v2}}\right|_C \approx \sqrt{1+\left(\frac{\omega L_1}{R_2}\right)^2}\cdot\left(\frac{1}{k^2}-1\right)\left|\frac{\Delta C_{b2}}{C_{b2}}\right| \tag{40}$$

The relative error of the voltage ratio on relative permeability change of the core material is $$\left|\frac{\Delta n_{v2}}{n_{v2}}\right|_\mu \approx \sqrt{1+\left(\frac{\omega L_1}{R_2}\right)^2}\cdot\left(\frac{1}{k^2}-1\right)\frac{\alpha}{(\alpha+\mu_r)}\left|\frac{\Delta\mu_r}{\mu_r}\right| \tag{41}$$

where, $\alpha=l_F/l_g$ is the ratio of the core magnetic circuit length to the air-gap magnetic circuit length; $\mu_r$ is the relative permeability of the inductors' core material.

The relative error of the current ratio on the devices' power-loss obtained from FIG. 5(*c*) is $$\left|\frac{\Delta n_{v2}}{n_{v2}}\right|_r \approx \frac{r_{b2}+r_1(k+1)}{k^2 R_2} \tag{42}$$

The prerequisite for Eq. (42) is that the quality factors of inductors $(1-k)L_1$ and $kL_1$ are equal. Design Key Points [Note: Refer to "6-1. *Design Instructions of the LC Combined Transformer and General Rules for Its Device Selections*"]: The error-designed parameter expression of this mutual capacitor is $$\sqrt{1+\left(\frac{\omega L_1}{R_2}\right)^2}\cdot\left(\frac{1}{k^2}-1\right);$$

which denotes that, to minimize the error, the value of $$\left(\frac{\omega L_1}{R_2}\right)$$

should be as small as possible, and the k value be as large as possible.

Device Selections: Device selection for capacitance Cb2 is the same as that for Cb1, because they will be merged together as one in the end, and the maximum voltage on Cb2 is calculated as follows $$U_{b2\ max} = \omega(1-k^2)L_1\cdot\frac{n_{v1}P}{V_1} = \omega\left(\frac{1}{k}-k\right)L_1\cdot\frac{P}{nV_2} \tag{43}$$

The core material for $L_1$ or the mutual inductor 26 should be selected, from Eqs. (41) and (42), of a high permeability and low core loss material. The prerequisite for Eq. (42) is that the quality factors of inductors $(1-k)L_1$ and $kL_1$ are equal, or $[\omega(1-k)L_1]/r_1=kL_1/r_k$, which is not easy to get into practice because $r_1$ is mainly the copper loss while $r_k$ is mainly iron loss. Try to decrease the difference between both as far as possible so as to be more accurate to estimate error by Eq. (42).

Now from Eqs. (28) and (38) as well as the ideal transformer's ratio n, the voltage ratio of entire in-phase mode of the voltage transformation type LC combined transformer will have the equation as $$n_v = \frac{V_1}{V_2} = \frac{V_1}{V_x}\cdot\frac{V_x}{V_y}\cdot\frac{V_y}{V_2} = n_{v1}\cdot n_{v2}\cdot n = knn_{v1} = \frac{knC_{b1}}{C_{b1}+C_m} \tag{44}$$

Eq. (44) indicates that the circuit illustrated in FIG. 5, under the conditions of above discussed, is an ideal voltage transformer because it operates a voltage transformation at a fixed ratio of ($V_1/V_2$), which is independent of the working frequency ω and the load R. It also shows that polarities of voltage transformation of $V_1$ and $V_2$ are in-phased, therefore, called the in-phase mode of the voltage transformation type LC combined transformer or in-phased ideal voltage transformer.

2-2. Anti-Phase Mode of the Voltage Transformation Type LC Combined Transformer

Figure 6:
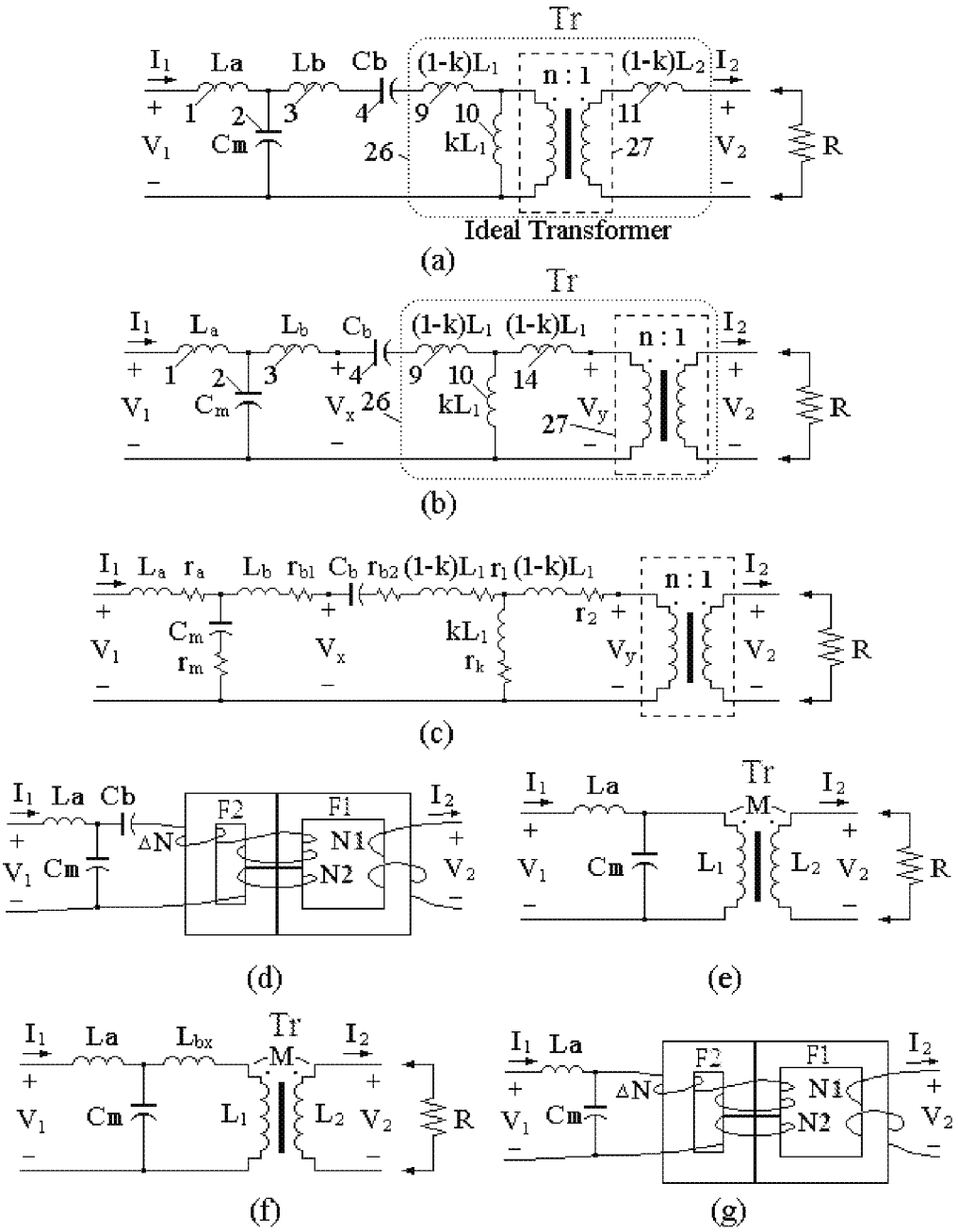
FIGS. 6(*a*), (*b*) and (*c*) are diagrams of the equivalent circuits for non-loss analysis and for loss analysis of the anti-phase mode of voltage transformation type of the LC combined transformer; (*d*) is that of its configuration employing the design approach of integrated inductor and mutual inductor; (*e*) is the simplest configured diagram when $\omega L_b - 1/\omega C_b = 0$; (*f*) is the configured diagram when $\omega L_{bx} = \omega L_b - 1/\omega C_b > 0$; (*g*) is a diagram for (*f*) when the integration design approach of inductor and mutual inductor employed.

In FIG. 2, let capacitor 5 open-circuited (i.e. $C_p=0$, $r_p\rightarrow+\infty$), though not excluding a round-off design of having capacitor 4 shot-circuited (i.e. $C_b\rightarrow+\infty$, $r_{b2}=0$), to obtain the anti-phase mode of the voltage transformation type LC combined transformer illustrated in FIG. 6(*a*). Imitating what has been done for the in-phase mode, equivalently reflect the leakage inductance 11 from the right side of the mutual inductor 26 onto the left side as inductor 14, shown as in FIG. 6(*b*); where inductors 1 and 3, plus capacitor 2 constitute the first LC subunit/subsystem, called tee (T) or wye (Y) mutual capacitor; capacitor 4, the leakage inductances 9 and 14 of the mutual inductor 26, and its magnetization inductance 10 constitute the second tee (T) or wye (Y) mutual capacitor; and the third part is the ideal transformer 27.

Still, assume that the first tee (T) mutual capacitor has an equivalent load of resistance $R_1$, then the voltage ratio will be $$n_{v1}=\frac{V_1}{V_x}=(1-\omega^2L_aC_m)+j\omega(L_a+L_b-\omega^2L_aL_bC_m)\frac{1}{R_1} \tag{45}$$

If setting component parameters to obtain the condition $$\omega^2C_m=\left(\frac{L_aL_b}{L_a+L_b}\right)=\omega^2C_m(L_a\,//\,L_b)=1 \tag{46}$$

we have $$n_{v1}=1-\omega^2L_aC_m=-\frac{L_a}{L_b} \tag{47}$$

Thus, the relative error of the voltage ratio on frequency change is $$\left|\frac{\Delta n_{v1}}{n_{v1}}\right|_\omega\approx\sqrt{1+\left(\frac{n_{v1}-1}{\omega n_{v1}C_mR_1}\right)^2}\cdot 2\left|\left(1-\frac{1}{n_{v1}}\right)\frac{\Delta\omega}{\omega}\right| \tag{48}$$

The relative error of the voltage ratio on capacitance change is $$\left|\frac{\Delta n_{v1}}{n_{v1}}\right|_C\approx\sqrt{1+\left(\frac{n_{v1}-1}{\omega n_{v1}C_mR_1}\right)^2}\cdot\left|\left(1-\frac{1}{n_{v1}}\right)\frac{\Delta C_m}{C_m}\right| \tag{49}$$

The relative error of the voltage ratio on relative permeability change of the core material is $$\left|\frac{\Delta n_{v1}}{n_{v1}}\right|_\mu\approx\sqrt{1+\left(\frac{n_{v1}-1}{\omega n_{v1}C_mR_1}\right)^2}\cdot\frac{\alpha}{(\alpha+\mu_r)}\left|\left(1-\frac{1}{n_{v1}}\right)\frac{\Delta\mu_r}{\mu_r}\right| \tag{50}$$

where, $\alpha=l_F/l_g$ is the ratio of the core magnetic circuit length to the air-gap magnetic circuit length; $\mu_r$ is the relative permeability of the inductors' core material. And the prerequisite for satisfying Eq. (50) is that $L_a$ and $L_b$ have cores of the same material and also of the same α value. The relative error of the current ratio on the devices' power-loss obtained from FIG. 6(*c*) is $$\left|\frac{\Delta n_{v1}}{n_{v1}}\right|_r\approx\frac{2(1-n_{v1})r_b}{R_1} \tag{51}$$

The prerequisite for Eq. (51) is that the quality factors or Q-values of inductors 1 or La and 3 or Lb should be equal, that is $\omega L_a/r_a=\omega L_b/r_b=Q$, as well as $r_m=r_a//r_b$ be managed to achieve. Besides, the value of R1 still could be worked out by Eq. (33).

Design Key Points [Note: Refer to "6-1. *Design Instructions of the LC Combined Transformer and General Rules for Its Device Selections*"]: This mutual capacitor has an error-designed parameter expression as $$\sqrt{1+\left(\frac{n_{v1}-1}{\omega n_{v1}C_mR_1}\right)^2}\cdot\left|1-\frac{1}{n_{v1}}\right|,$$

which shows that, to have a small error, the values of Cm and $n_{v1}$ have to be large. In addition, if the positions of Lb and Cb are interchanged in the circuit, the circuit function will remain unchanged so that inductor 3 of Lb and the mutual inductor 26 could be constructed as an integrated inductor & mutual inductor as schematically illustrated in FIG. 6(*d*). Device Selections: Device selection of capacitor $C_m$ requires the value precision grade and the temperature coefficient taken as high as possible based on the requests of design. The maximum voltage on Cm will be determined as $$U_{mmax}\geq 2V_x\sqrt{1-\left(\frac{\omega L_b}{R_1}\right)^2}=\frac{2V_1}{n_{v1}}\sqrt{1+\left(\frac{\omega L_b}{R_1}\right)^2} \tag{52}$$

Moreover, Eq. (51) requires that $C_m$'s equivalent series resistance, $r_m=r_a//r_b$, to which a solution is to insert a proper resistance connected in series with it, with the only concerning that you should weigh and balance the necessity of paying a price of power dissipation. Inductors of $L_a$ and $L_b$ are selected as stated before, with the requests of the same α value and of the same Q-value.

The second mutual capacitor has a same equation as that in the in-phase mode (excepting that now in FIG. 6, Cb must take the place of $C_{b2}$ in FIG. 5. Thus, borrow the result from that as is in the in-phase mode and obtain the voltage ratio of the anti-phase mode of the voltage transformation type LC combined transformer as $$n_v=\frac{V_1}{V_2}=\frac{V_1}{V_x}\cdot\frac{V_x}{V_y}\cdot\frac{V_y}{V_2}=n_{v1}\cdot n_{v2}\cdot n=knn_{v1}=-kn\frac{L_a}{L_b} \tag{53}$$

This equation indicates that the circuit illustrated in FIG. 6, when satisfying the conditions of above stated, is also an ideal voltage transformer, because it also operates a voltage transformation at a fixed ratio of ($V_1/V_2$) independently, though the voltage polarities of input and output anti-phased; which is why, called the anti-phase mode of the voltage transformation type LC combined transformer or anti-phased ideal voltage transformer.

If going one more step further, make $$\omega L_b - \frac{1}{\omega C_b} = 0$$

in FIGS. 6(*a*) and (*b*); from Eqs. (37), (46) and (47), getting $$L_b = (1-k^2)L_1 \tag{54}$$

$$\text{and } \omega^2 Cm(1-k^2)L_1 = 1+1/|n_{v1}| \tag{55}$$

Hence the circuit has its simplified configuration (see FIG. 6(*e*)). Similarly, once more assume $$\omega L_{bx} = \omega L_b - \frac{1}{\omega C_b} > 0, \text{ i.e. when} \tag{56}$$

$$L_{bx} = L_b - \frac{1}{\omega^2 C_b} = L_b - (1-k^2)L_1 > 0$$

the circuit could leave out $C_b$ as in FIG. 6(*f*) as well as in FIG. 6(*g*) by the integration design of inductor and mutual inductor.

3. Voltage and Current Transformation Type LC Combined Transformer (Ideal Transformer)

The voltage and current transformation type of the LC combined transformer, or the ideal transformer, is actually the technological extension expanded either from the voltage transformation type LC combined transformer to the current transformation type, or from the current transformation type LC combined transformer to the voltage transformation type. Accordingly, for the former there exist two configurations of circuit designs of in-phase mode and anti-phase mode; and for the latter there also exist two circuit configurations of transformation-A type and transformation-B type.

Figure 7:
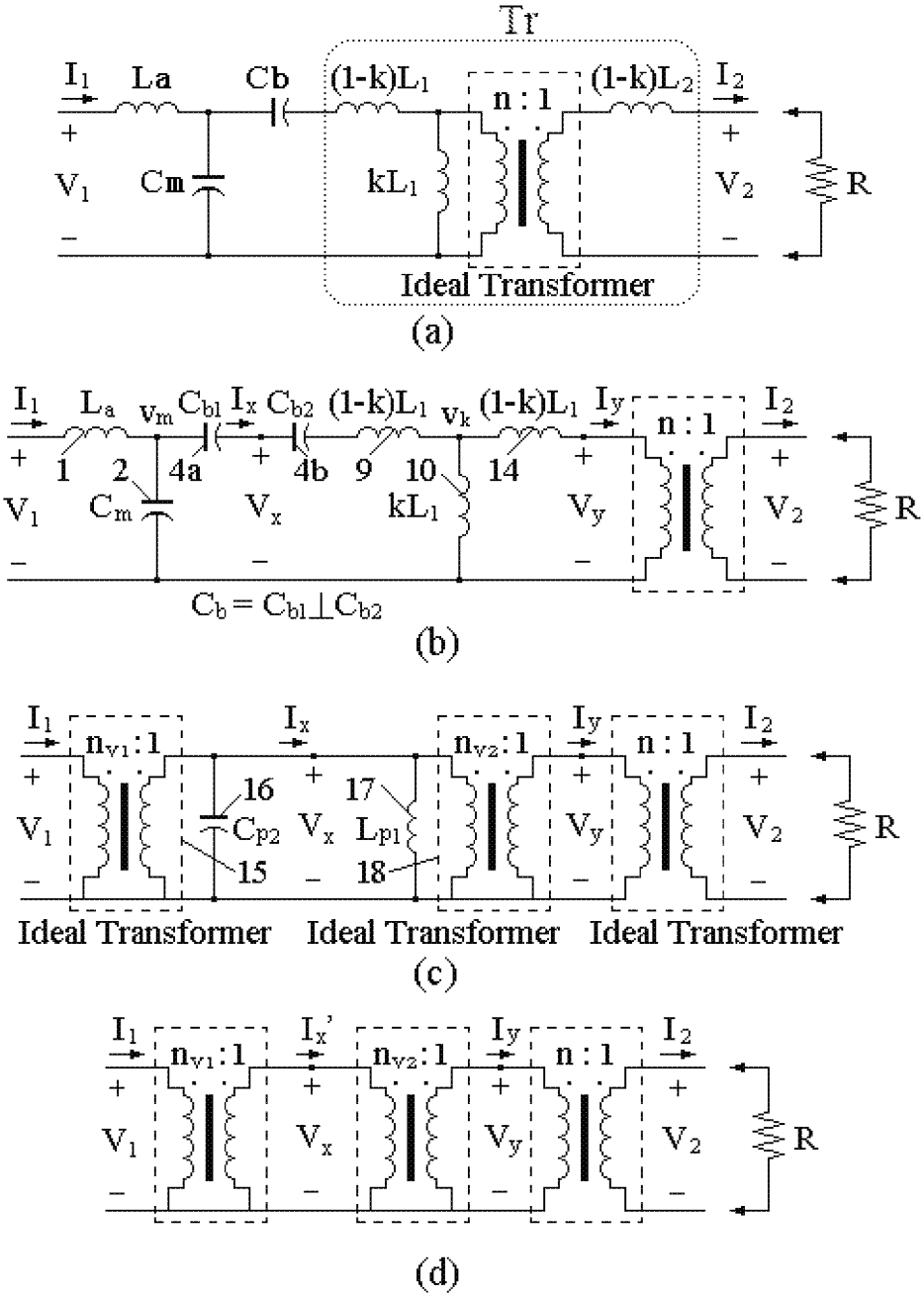
FIGS. 7 (*a*) and (*b*) are duplicates of FIGS. 5 (*a*) and (*b*); (*c*) is a diagram of their equivalent circuit expressed by employing an ideal transformer; (*d*) is for (c), when $\omega C_{p2} = 1/\omega L_{p1}$, namely, Eq. (60) satisfied, evolved into the equivalent circuit diagram of in-phase mode of voltage and current transformation type of the LC combined transformer.

3-1. In-Phase Mode of the Voltage and Current Transformation Type LC Combined Transformer Firstly review the in-phase mode of the voltage transformation type LC combined transformer and redraw the circuit diagrams in FIGS. 5(*a*) and (*b*) as in FIGS. 7(*a*) and (*b*). In FIG. 7(*b*), of the first tee (T) mutual capacitor consisting of inductor 1, capacitors 2 and 4*a*, the currents $$\begin{aligned} I_1 &= \frac{V_1 - v_m}{j\omega L_a} \\ &= \frac{V_1 - V_x}{j\omega L_a} - \frac{(v_m - V_x)j\omega C_{b1}}{j\omega L_a \cdot j\omega C_{b1}} \\ &= \left(1 - \frac{1}{n_v}\right)\frac{V_1}{j\omega L_a} + \frac{I_x}{\omega^2 L_a C_{b1}} \\ &= j\omega\left(\frac{C_m}{n_{v1}}\right)V_1 + \frac{1}{n_{v1}}I_x \\ &= j\omega C_{p1}V_1 + \frac{1}{n_{v1}}I_x, \left(C_{p1} = \frac{C_m}{n_{v1}}\right) \end{aligned} \tag{57}$$

$$\begin{aligned} I_x &= n_{v1}I_1 - j\omega C_m V_1 \\ &= n_{v1}I_1 - j\omega(n_{v1}C_m)V_2 \\ &= n_{v1}I_1 - j\omega C_{p2}V_2, (C_{p2} = n_{v1}C_m) \end{aligned} \tag{58}$$

From Eqs. (28) and (58), an equivalent circuit, between $V_1$ and $V_x$ in FIG. 7(*c*), of the ideal transformer 15 and its secondary-side paralleled capacitance 16 or $C_{p2}$ is evolved. In the same way, of the second tee (T) mutual capacitor consisting of capacitor 4*b*, the mutual inductor's two leakage inductances 9 and 14, and also the magnetization inductance 10, there is a current as $$\begin{aligned} I_x &= \frac{V_x - v_k}{j\omega(1-k)L_1 + \frac{1}{j\omega C_{b2}}} \\ &= \frac{V_x - V_y}{j\omega(1-k)L_1 + \frac{1}{j\omega C_{b2}}} - \frac{(v_k - V_y)}{j\omega(1-k)L_1\left[1 - \frac{1}{\omega^2 C_{b2}(1-k)L_1}\right]} \\ &= \left(1 - \frac{1}{n_{v2}}\right)\frac{V_x}{j\omega(1-k)L_1\left[1 - \frac{1}{\omega^2 C_{b2}(1-k)L_1}\right]} + \frac{1}{n_{v2}}I_y \\ &= \frac{V_x}{j\omega(n_{v2}\cdot kL_1)} + \frac{1}{n_{v2}}I_y \\ &= \frac{V_x}{j\omega L_{p1}} + \frac{1}{n_{v2}}I_y, (L_{p1} = n_{v2}\cdot kL_1 = k^2L_1) \end{aligned} \tag{59}$$

From Eqs. (38) and (59), achieve the equivalent circuit of inductance 17 in parallel with the primary of the ideal transformer 18, evolved from that between $V_x$ and $V_y$ in FIG. 7(*b*). Then, assume that the component parameters satisfying the condition $\omega C_{p2} = 1/\omega L_{p1}$, i.e.

$$\begin{aligned} \omega^2 C_{p2}L_{p1} &= \omega^2 n_{v1}C_m k^2 L_1 \\ &= \omega^2(1-n_{v1})C_{b1}k^2L_1 \\ &= \omega^2\frac{C_{b1}C_m}{C_{b1}+C_m}k^2L_1 \\ &= \omega^2 k^2 L_1(C_{b1} \perp C_m) \\ &= 1 \end{aligned} \tag{60}$$

and notice Eq. (27) and $C_b = C_{b1} \perp C_{b2}$, we achieve that, when $$\omega^2 L_1\left(\frac{C_b C_m}{C_b + C_m}\right) = \omega^2 L_1(C_b \perp C_m) = 1, \tag{61}$$

$$\left(C_b = \frac{C_{b1}C_m}{(C_{b1}+C_m)/k^2 - C_{b1}}\right)$$

FIG. 7(*c*) is in circuitry equalized as FIG. 7(*d*) with its voltage and current equations as $$\frac{V_1}{V_2} = \frac{\frac{V_1}{V_x}\cdot}{\frac{V_x}{V_y}\cdot\frac{V_y}{V_2}} = \frac{n_{v1}\cdot}{n_{v2}\cdot n} = n_v = \frac{nkC_{b1}}{C_{b1}+C_m} = \frac{\frac{n}{k}\cdot}{\frac{C_b}{C_b+C_m}} \tag{62}$$

$$\frac{I_1}{I_2} = \frac{\frac{I_1}{I_x}\cdot}{\frac{I_x}{I_y}\cdot\frac{I_y}{I_2}} = \frac{\frac{1}{n_{v1}}\cdot}{\frac{1}{n_{v2}}\cdot\frac{1}{n}} = \frac{1}{n_v} = \frac{C_{b1}+\frac{C_m}{nkC_{b1}}}{} = \frac{k}{n}\left(\frac{1+\frac{C_m}{C_b}}{}\right) \tag{63}$$

They appear completely as the forms of ideal transformer's equations, termed the in-phase mode of the voltage and current transformation type LC combine transformer or in-phased ideal transformer.

And from Eqs. (27) and (61) we have $$L_a = \frac{1}{\omega^2(C_{b1}+C_m)} = \frac{1-n_{v1}}{\omega^2 C_m} = \frac{1}{\omega^2 C_m}\left[1-\frac{C_b}{k^2(C_b+C_m)}\right] \quad (64)$$

Design Key Points: The in-phase mode of the voltage and current transformation type LC combine transformer (see FIG. 7) is just the improvement or upgraded from the in-phase mode of the voltage transformation type LC combine transformer. Hence, its error analysis, design key points, and device selections all are the same as the according contents respectively of the latter stated above, with a difference that the former functions as the input and output current in-phased, just one more step developed beyond the latter.

However, the two mutual capacitors of the in-phased ideal transformer in FIG. 7 are implicated with each other during the specific designing, especially on the adjustment. In practical engineering, especially on spot test or adjustment, deviations of parameter values, influenced by lots of factors, are fated, although parameter value precision grades are ensured as high as possible in the course of designing and manufacturing; and micro-adjustments are ineluctable. Here present two methods shown in the following that can be used for on-site micro-adjustments.

Method I: Take $L_p(<<L_1)$ as a micro-adjustable inductor, and connect $L_p$ in series with the primary winding $N_1$ of the mutual inductor. Then Eq. (36) will become $$n_{v2} = \frac{V_x}{V_y} = \frac{1}{k}\left[\frac{\left(1-\frac{1}{\omega^2 L_1 C_{b2}}\right)+\frac{1-\omega^2 C_{b2}[(1-k^2)L_1+L_p]}{j\omega C_{b2}\cdot R_2}}{}\right] \quad (36a)$$

Accordingly, Eq. (37) could be as $$\omega^2 C_{b2}[(1-k^2)L_1+L_p]=1 \quad (37a)$$

Eq. (38) as $$n_{v2} = \frac{V_x}{V_y} = \frac{1}{k}\left(1-\frac{1}{\omega^2 L_1 C_{b2}}\right) = k\left(1-\frac{L_p}{k^2 L_1}\right), \text{ or} \quad (38a)$$

Method II: Put a micro-adjustable inductor $L_s(<<L_2)$ in series with the secondary side of the mutual inductor. Then Eq. (36) will become $$n_{v2} = \frac{V_x}{V_y} = \frac{1}{k}\left[\frac{\left(1-\frac{1}{\omega^2 L_1 C_{b2}}\right)+\frac{(1+L_s/L_1)-\omega^2 C_{b2}L_1(1+L_s/L_2-k^2)}{j\omega C_{b2}\cdot R_2}}{}\right] \quad (36b)$$

$$\omega^2 L_1 C_{b2}\left(1-\frac{k^2}{1+L_s/L_2}\right) = \omega^2 L_1 C_{b2}(1-kn_{v2}) = 1 \quad (37b)$$

$$n_{v2} = \frac{V_x}{V_y} = \frac{1}{k}\left(1-\frac{1}{\omega^2 L_1 C_{b2}}\right) = \frac{k}{1+L_s/L_2} \quad (38b)$$

Eq. (37) as $$\omega^2 L_1 C_{b2}\left(1-\frac{k^2}{1+L_s/L_2}\right) = \omega^2 L_1 C_{b2}(1-kn_{v2}) = 1 \quad (37b)$$

and Eq. (38) as $$n_{v2} = \frac{V_x}{V_y} = \frac{1}{k}\left(1-\frac{1}{\omega^2 L_1 C_{b2}}\right) = \frac{k}{1+L_s/L_2} \quad (38b)$$

Moreover, the two methods stated above are suited only when the k value of the mutual inductor is slightly greater than originally tested or $L_1$ a bit less than designed. To match their uses, the coil winding of $L_1$ should be pre-set a tap at the position of just a little bit fewer turns next to an end to make it have an inductance slightly less than originally designed. In this way, once either of the two cases above-mentioned occurs, the pre-set tap in series with the $L_p$, take Method I for an example, could be connected to where $N_1$ ought to so that flexible micro-adjustments could be implemented. Obviously, such a way has also slightly changed the ratio of the entire transformer; when necessary, revision should be made.

Figure 8:
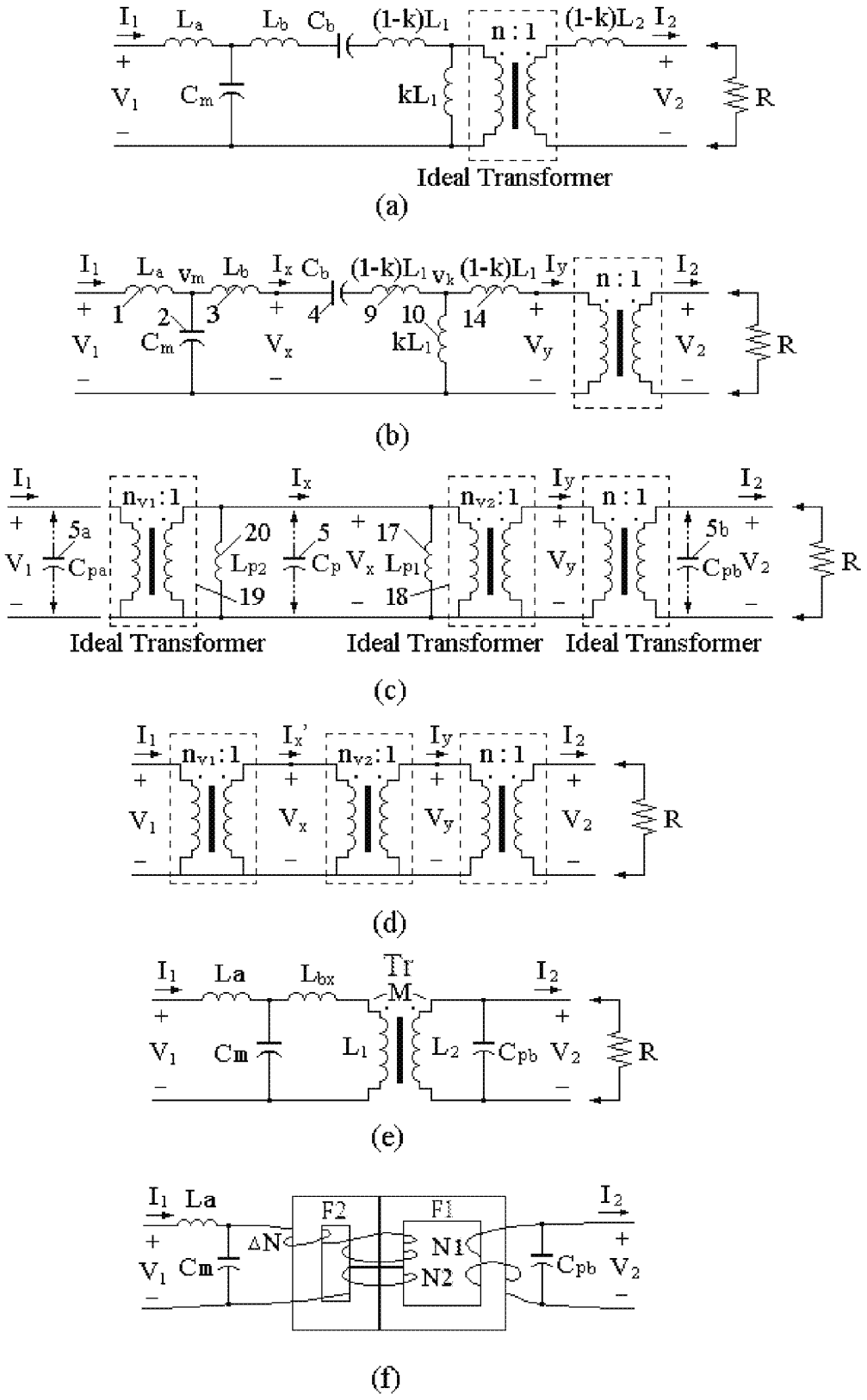
FIGS. 8 (*a*) and (*b*) are duplicates of FIGS. 6 (*a*) and (*b*); (*c*) is a diagram of their equivalent circuit expressed by employing an ideal transformer and also of the trends or methods evolving to be an ideal transformer; (*d*) is in (c) with a compensation capacitor, like Cp, Cpa or Cpb inserted in parallel connection to satisfy any of Eqs. (66), (67) and (68), the evolved equivalent circuit diagram of anti-phase mode of voltage and current transformation type of the LC combined transformer (ideal transformer); (*e*) and (*f*), respectively corresponding to FIGS. 6 (*f*) and (*g*), are diagrams of the ideal transformer configuration.

3-2. Anti-Phase Mode of the Voltage and Current Transformation Type LC Combined Transformer In the same way, redraw the circuit diagrams of the anti-phase mode of the voltage transformation type LC combined transformer in FIGS. 6(*a*) and (*b*) as in FIGS. 8(*a*) and (*b*). In FIG. 8(*b*), of the first tee (T) mutual capacitor consisting of inductors 1 and 3, capacitor 2, the current $$I_x = n_{v1}I_1 - \frac{V_x}{j\omega[(L_a // L_b)/|n_{v1}|]} = n_{v1}I_1 - \frac{V_2}{j\omega L_{p2}}, \quad \left(L_{p2} = \frac{L_a // L_b}{|n_{v1}|}\right) \quad (65)$$

By Eqs. (47) and (65), electrically equalize the first mutual capacitor in FIG. 8(*b*) as an ideal transformer 19 with its secondary in parallel with inductance 20 illustrated in FIG. 8(*c*). Of the second tee (T) mutual capacitor in FIG. 8(*b*) consisting of capacitor 4, both of the mutual inductor's leakage inductances 9 and 14, and the magnetization inductance 10, the expressions of $I_x$ and $L_{p1}$ are identical to Eq. (59) so that its equivalent circuit could be the same as in FIG. 7(*c*) of inductance 17 or $L_{p1}$ in parallel with the primary of ideal transformer 18, and the circuit in FIG. 8(*b*) will be in circuitry equalized as in FIG. 8(*c*). Furthermore, if a reactive compensation capacitor 5 or $C_p$ inserted in parallel connection at the position of $V_x$ in FIG. 8(*c*), or according to practical necessity, either capacitor 5*a* or $C_{pa}$ at $V_1$, or capacitor 5*b* or $C_{pb}$ at $V_2$, with their values respectively as $$C_p = \frac{1}{\omega^2(L_{p1} // L_{p2})} = \frac{1}{\omega^2}\left(\frac{1}{k^2 L_1}+\frac{1+L_a/L_b}{L_b}\right) \quad (66)$$

$$C_{pa} = C_p/n_{v1}^2 = \frac{1}{\omega^2}\left(\frac{1}{k^2 L_1}+\frac{1+L_a/L_b}{L_b}\right)\left(\frac{L_b}{L_a}\right)^2 \quad (67)$$

$$C_{pb} = k^2 n^2 C_p = \frac{n^2}{\omega^2}\left[\frac{1}{L_1}+\frac{k^2(1+L_a/L_b)}{L_b}\right] \quad (68)$$

After compensated, functions of the circuit in FIG. 8 can be specifically and equivalently described as the form of ideal transformers illustrated in FIG. 8(*d*), with its voltage and current relationships as $$\begin{cases} \frac{V_1}{V_2} = \frac{V_1}{V_x} \cdot \frac{V_x}{V_y} \cdot \frac{V_y}{V_2} = n_{v1} \cdot n_{v2} \cdot n = n_v = -\frac{nkL_a}{L_b} & (69) \\ \frac{I_1}{I_2} = \frac{I_1}{I_x} \cdot \frac{I_x}{I_y} \cdot \frac{I_y}{I_2} = \frac{1}{n_{v1}} \cdot \frac{1}{n_{v2}} \cdot \frac{1}{n} = \frac{1}{n_v} = -\frac{L_b}{nkL_a} & (70) \end{cases}$$

These equations show the relationships of anti-phased voltages and currents, termed the anti-phase mode of the voltage and current transformation type LC combined transformer or anti-phased ideal transformer. As well, here present the circuit configurations of the ideal transformers which are upgraded from FIGS. 6(*f*) and (*g*) respectively as in FIGS. 8(*e*) and (*f*).

Design Key Points: In the same way as in the in-phase mode, the anti-phase mode of the voltage and current transformation type LC combine transformer (see FIG. 8) is also just the improvement or upgraded from the anti-phase mode of the voltage transformation type LC combine transformer. Hence, its error analysis, design key points, and device selections are all the same as the according contents respectively of the latter stated above, with a difference that the former functions as its input and output current exactly anti-phased, just one more step developed beyond the latter.

3-3. Voltage and Current Transformation-A Type LC Combined Transformer

Figure 9:
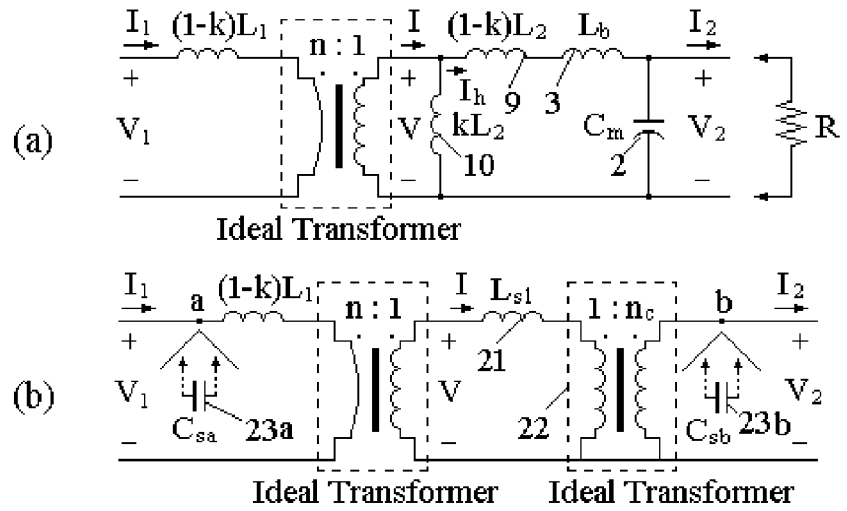
FIG. 9 (*a*) is a duplicate of FIG. 3 (*a*); (*b*) is a diagram of its equivalent circuit expressed by employing an ideal transformer; (*c*) is in (b) with a compensation capacitor, Csa or Csb, inserted in series connection to satisfy either Eqs. (72) or (73), the evolved equivalent circuit diagram of voltage and current transformation-A type of the LC combined transformer (Ideal Transformer A).

Firstly review the current transformation-A type of the LC combined transformer and redraw the circuit diagram in FIG. 3(*a*) as in FIG. 9(*a*). In FIG. 9(*a*), of the delta (Δ) or pi (π) mutual capacitor consisting of inductances 3, 9, 10, and capacitor 2, the voltage $$\begin{aligned} V &= j\omega(I - I_h)kL_2 = j\omega(I - I_2)kL_2 - j\omega(I_h - I_2)kL_2 \\ &= j\omega\left(I - \frac{I}{n_c}\right)kL_2 - j\omega(j\omega C_m V_2)kL_2 \\ &= j\omega\left(1 - \frac{1}{n_c}\right)kL_2 I + \omega^2 kL_2 C_m V_2 \\ &= j\omega L_{s1} I + \frac{1}{n_c} V_2; \left[L_{s1} = \left(1 - \frac{1}{n_c}\right)kL_2\right] \end{aligned} \quad (71)$$

From Eqs. (10) and (71), obtain the equivalent circuit, between V and $V_2$ in FIG. 9(*b*), within which the ideal transformer 22 has an equivalent input inductance 21 or $L_{s1}$ of the mutual capacitor, connected in series with its primary winding. Next, let's insert a compensation capacitor 23*a* or $C_{sa}$ in series connection at point a of input port, or when necessary, insert a compensation capacitor 23*b* or $C_{sb}$ in series connection at point b of output port, with their capacitance values respectively as $$C_{sa} = \frac{1}{\omega^2[(1-k)L_1 + n^2 L_{s1}]} = \frac{1}{\omega^2 L_1(1 - k/n_c)} \quad (72)$$

$$C_{sb} = \frac{1}{\omega^2 n_c^2[(1-k)L_2 + L_{s1}]} = \frac{1}{\omega^2 n_c L_2(n_c - k)} \quad (73)$$

Functions of the circuit in FIG. 9(*b*) after compensation can be equivalently expressed as the form of ideal transformers in cascaded connection, with the voltage and current relationships as $$\begin{cases} \frac{V_1}{V_2} = \frac{V_1}{V} \cdot \frac{V}{V_2} = n \cdot \frac{1}{n_c} = \frac{nkL_2}{L_b + L_2} & (74) \\ \frac{I_1}{I_2} = \frac{I_1}{I} \cdot \frac{I}{I_2} = \frac{1}{n} \cdot n_c = \frac{L_b + L_2}{nkL_2} & (75) \end{cases}$$

They perfectly appear as the forms of an ideal transformer's equations, referred to as the voltage and current transformation-A type of the LC combined transformer, or transformation-A ideal transformer or ideal transformer A, when the circuit in FIG. 9 satisfying the condition either of Eqs. (72) and (73).

Design Key Point: The voltage and current transformation-A type LC combined transformer (FIG. 9) is just the improvement or upgraded from the current transformation-A type of the LC combined transformer. Hence, its error analysis, design key points, and device selections are all the same as the according contents respectively of the latter stated above, with a difference that the former functions as the input and output voltage in-phased, just one more step developed beyond the latter.

3-4. Voltage and Current Transformation-B Type LC Combined Transformer

Figure 10:
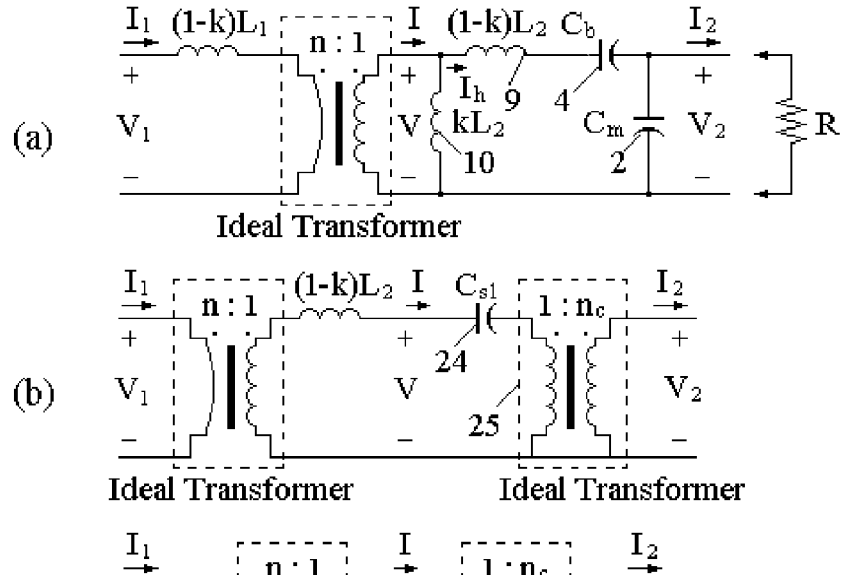
FIG. 10 (*a*) is a duplicate of FIG. 4 (*a*); (*b*) is a diagram of its equivalent circuit expressed by employing an ideal transformer; (*c*) is in (b) when $n_c = k$, namely Eq. (78) satisfied, the evolved equivalent circuit diagram of voltage and current transformation-B type of the LC combined transformer (Ideal Transformer B).

In the same way, redraw the circuit diagram of the current transformation-B type LC combined transformer in FIG. 4(*a*) as in FIG. 10(*a*). In FIG. 10(*a*), of the delta (Δ) or pi (π) mutual capacitor consisting of inductances 9 and 10, and capacitors 2 and 4, the voltage $$\begin{aligned} V &= j\omega(I - I_h)kL_2 = j\omega(I - I_2)kL_2 - j\omega(I_h - I_2)kL_2 \\ &= j\omega\left(I - \frac{I}{n_c}\right)kL_2 - j\omega(j\omega C_m V_2)kL_2 \\ &= j\omega\left(1 - \frac{1}{n_c}\right)kL_2 I + \omega^2 kL_2 C_m V_2 \\ &= j\omega L_{s1} I + \frac{1}{n_c} V_2; \left[L_{s1} = \left(1 - \frac{1}{n_c}\right)kL_2, \text{ when } n_c \geq 1\right] \end{aligned} \quad (76)$$

$$\begin{aligned} &= j\left(1 - \frac{1}{n_c}\right) \cdot \frac{1}{\omega n_c C_m} \cdot I + \frac{1}{n_c} V_2 \\ &= \frac{1}{j\omega C_{s1}} I + \frac{1}{n_c} V_2; \left(C_{s1} = \frac{n_c^2 C_m}{1 - n_c}, \text{ when } n_c < 1\right) \end{aligned} \quad (77)$$

In most cases, there exists $n_c<1$; thus the equation above should be expressed as taking on the series equivalent capacitance $C_{s1}$ as in Eq. (77) so that in FIG. 10, the delta (Δ) mutual capacitor between V and $V_2$ can be replaced by an equivalent circuit of an ideal transformer 25 connected in series to its primary with the equivalent input capacitance 24 or $C_{s1}$, while the mutual inductor's primary leakage inductance $(1-k)L_1$ in FIG. 10(*a*) is equalized as its secondary leakage inductance $(1-k)L_2$ in FIG. 10(*b*). Next, assume $$j\omega(1-k)L_2 + \frac{1}{j\omega C_{s1}} = 0,$$

$$\text{i.e. } \omega^2(1-k)L_2 C_{s1} = \omega^2(1-k)L_2 \frac{n_c^2 C_m}{1 - n_c} = 1,$$

$$\text{or } \omega^2(1-k)L_2 n_c^2 C_m = 1 - n_c;$$

and notice Eq. (20), namely $$\omega^2 L_2 C_m = \frac{1}{kn_c},$$

being substituted in as $$\frac{1-k}{k}\cdot n_c = 1 - n_c,$$

or say when $n_c$=k, or $$\frac{C_m}{C_b} = \frac{1}{k^2} - 1 \tag{78}$$

FIG. 10(*b*) could be equivalently replaced as FIG. 10(*c*), with the network port voltage and current equations as $$\begin{cases} \frac{V_1}{V_2} = \frac{V_1}{V}\cdot\frac{V}{V_2} = n\cdot\frac{1}{n_c} = nk\left(1+\frac{C_m}{C_b}\right) & (79) \\ \frac{I_1}{I_2} = \frac{I_1}{I}\cdot\frac{I}{I_2} = \frac{1}{n}\cdot n_c = \frac{C_b}{nk(C_b+C_m)} & (80) \end{cases}$$

These are also equations of an ideal transformer, which is why the circuit in FIG. 10, when satisfying condition Eq. (78), is referred to as the voltage and current transformation-B type of the LC combined transformer, or transformation-B ideal transformer or ideal transformer B.

Design Key Point: The voltage and current transformation-B type LC combined transformer (FIG. 10) is also just the improvement or upgraded from the current transformation-B type of the LC combined transformer. Hence, its error analysis, design key points, and device selections are all the same as the according contents respectively of the latter stated above, with a difference that the former functions as the input and output voltage in-phased, just one more step developed beyond the latter.

4. Function of Waveform Conversion from Square to Quasi-Sine

All the three categories or types of the LC combined transformers presented by this invention possess the function of waveform conversion or waveform isolation from square to quasi-sine [Note: Take the fundamental filter of square wave as a typical example of waveform conversion, and the rectifier transformer as a typical application of waveform isolation]. The following analysis and explanations are just one example narrating its operating principle and effect [Note: Also see "6-3. *Functions of Waveform Conversion from Square to Quasi-Sine of the Mutual Capacitor* (*Continue*)"].

Let's investigate the operating state of an in-phase mode voltage transformation type LC combined transformer in FIG. 5 being applied with a supply of periodic square-wave sequence.

Assuming that $v_1(t)$ is a voltage of symmetrical periodic square-wave supplying across the input port of the mutual capacitor, with a cyclic frequency $\omega=2\pi f=2\pi/T$ and its Fourier's series as $$v_1(t)=V_{11}\sin\omega t+V_{13}\sin 3\omega t+V_{15}\sin 5\omega t+\ldots+V_{1m}\sin k\omega t+\ldots,\ (m=1,3,5,\ldots) \tag{81}$$

where, $V_{11}$, $V_{13}$, $V_{15}$ . . . respectively mean the amplitudes/magnitudes of the fundamental, third harmonic, fifth harmonic . . . etc. In addition, the magnitude ratio of m-th harmonic to fundamental for a symmetrical periodic square-wave, consulting a textbook, is $V_{1m}/V_{11}$=1/m.

From Eqs. (26) to (28), the magnitude of the m-th harmonic of the output voltage $V_x$ of the first mutual capacitor in FIG. 5 under the implement of $v_1$ (t) will be worked out as $$|V_{xm}| = \frac{|V_{1m}|}{\sqrt{[1-m^2(1-n_{v1})]^2 + \left[\frac{1}{\omega C_m R_1}\left(\frac{1}{n_{v1}}-1\right)\left(\frac{1}{m}-m\right)\right]^2}} \tag{82}$$

or expressed as $$\left|\frac{V_{xm}}{V_{x1}}\right| = \left|\frac{V_{1m}}{V_{11}}\right|\cdot\frac{n_{v1}}{\sqrt{[1-m^2(1-n_{v1})]^2 + \left[\frac{1}{\omega C_m R_1}\left(\frac{1}{n_{v1}}-1\right)\left(\frac{1}{m}-m\right)\right]^2}}$$

$$= \frac{1}{m}\cdot\frac{n_{v1}}{\sqrt{[1-m^2(1-n_{v1})]^2 + \left[\frac{1}{\omega C_m R_1}\left(\frac{1}{n_{v1}}-1\right)\left(\frac{1}{m}-m\right)\right]^2}} \tag{83}$$

By this equation, calculate when $n_{v1}$=0.75, 0.5, 0.25, $\omega C_m R_1$=0.1, 1, 2, 10, 100, the values of $$\left|\frac{V_{xm}}{V_{x1}}\right|$$

for the mutual capacitor as recorded in the following form:

| | | $\lvert V_{xm}/V_{x1}\rvert$, when m = | | | | | |
|---|---|---|---|---|---|---|---|
| $n_{v1}$ | $\omega C_m R_1$ | 1 | 3 | 5 | 7 | 9 | 11 |
| 0.75 | 0.1 | 1.0000 | .0278 | .0089 | .0042 | .0024 | .0015 |
| | 1 | 1.0000 | .1630 | .0273 | .0093 | .0043 | .0023 |
| | 2 | 1.0000 | .1884 | .0282 | .0095 | .0043 | .0023 |
| | 10 | 1.0000 | .1995 | .0286 | .0095 | .0043 | .0023 |
| | 100 | 1.0000 | .2000 | .0286 | .0095 | .0043 | .0023 |
| 0.50 | 0.1 | 1.0000 | .0062 | .0020 | .0010 | .0006 | .0004 |
| | 1 | 1.0000 | .0379 | .0080 | .0029 | .0014 | .0008 |
| | 2 | 1.0000 | .0445 | .0085 | .0030 | .0014 | .0008 |
| | 10 | 1.0000 | .0475 | .0087 | .0030 | .0014 | .0008 |
| | 100 | 1.0000 | .0476 | .0087 | .0030 | .0014 | .0008 |
| 0.25 | 0.1 | 1.0000 | .0010 | .0003 | .0002 | .0001 | .0001 |
| | 1 | 1.0000 | .0085 | .0022 | .0009 | .0004 | .0002 |
| | 2 | 1.0000 | .0119 | .0026 | .0010 | .0005 | .0002 |
| | 10 | 1.0000 | .0144 | .0028 | .0010 | .0005 | .0003 |
| | 100 | 1.0000 | .0145 | .0028 | .0010 | .0005 | .0003 |

Form 1 List for calculations of $|V_{xm}/V_{x1}|$ by Eq. (83) when $n_{v1}$ and $\omega C_m R_1$ have different values Design Considerations: From the results of the listed data, the influence upon the output voltage by the harmonics of fifth and over is almost negligible; the influence of the third harmonic increasing accompanied with the increase of $n_{v1}$ (generally, negligible when $n_{v1}\leq 0.5$); the change of ($\omega C_m R_1$) showing the load-carrying capacity of the mutual capacitor not bad, with the load heavier the better fundamental filtering characteristic of the mutual capacitor. However, the heavier load for the mutual capacitor, the worse errors which are determined by Eqs. (29) through (32). Therefore, during designing in practice, balances need to be made on or between the filtering characteristic, the load-carrying capacity, and the ratio errors.

5. Utilization of Push-Pull on Inductor

Figure 11:
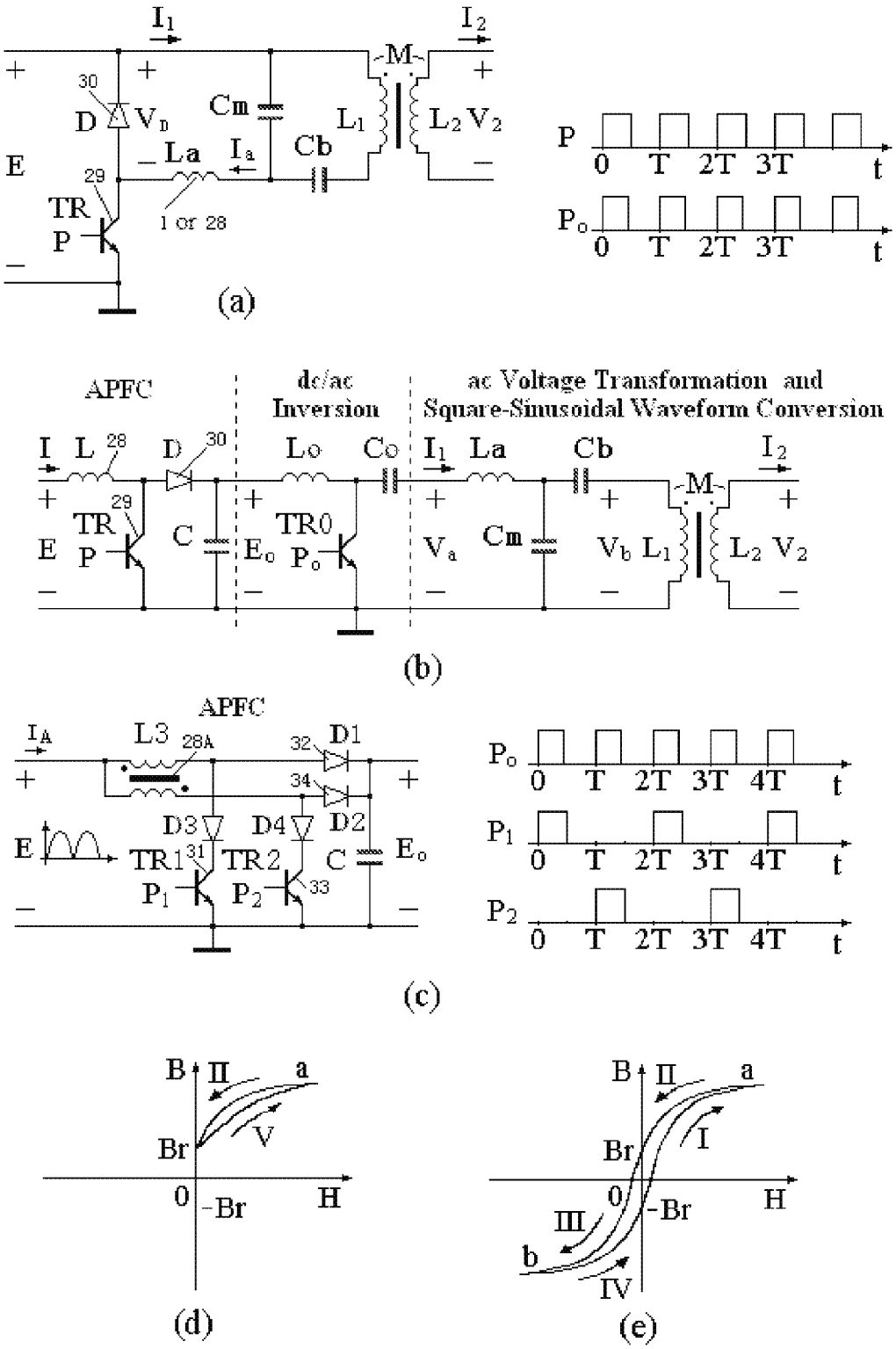
FIG. 11(*a*) is a diagram of principle and experimental circuit using FIG. 5 or FIG. 7 to implement the waveform conversion from square to quasi-sine; (*b*) is an entire circuit diagram of a principle and experimental circuit to implement functions of APFC, dc-ac inversion, voltage transformations and the waveform conversion from square to quasi-sine using either FIG. 5 or FIG. 7; (*c*) is an improved circuit upgraded from sub-circuit of APFC in (b) by employing the push-pull inductor; (*d*) is the hysteresis loop of the core of inductor L in (b) in steady-state operation; (*e*) is the hysteresis loop of the core of inductor 28A in (c) in steady-state operation.

The utilization of push-pull on inductor is also termed the use of push-pull inductor. FIG. 11(*a*) is a diagram of principle and experimental circuit using FIG. 5 or FIG. 7 to implement the waveform conversion from square to quasi-sine. FIG. 11 (*b*) is an entire circuit diagram of a principle scheme and also an experimental circuit which includes three sub-circuits to implement functions of APFC (active power factor correction), dc-ac inversion, voltage transformations and the waveform conversion from square to quasi-sine using either FIG. 5 or FIG. 7. Either the inductor La in FIG. 11(*a*) or the inductor L in FIG. 11 (*b*) can be developed with a center-tapped inductor, or by the use of push-pull inductor. For a detailed narration, FIG. 11(*c*) is an improvement or upgrade of APFC from sub-circuit in FIG. 11(*b*) by employing the push-pull inductor.

In FIG. 11(*b*), when the control-input terminal P of switch 29 or TR is input the signal of a waveform, the waveform of the collector voltage of switch 29 is also a single-polar pulsed square-wave sequence in similar with P, while the input current I is also a single-polar periodic waveform; by which the cores of inductor 28 or L gets magnetized with a locus curve or hysteresis loop as shown in FIG. 11 (*d*). Within a cycle in steady-state operation of the circuit in FIG. 11(*b*), commencing at point Br in FIG. 11(*d*) when switch 29 or TR closed and switch 30 or D open, i.e. I increasing, the magnetic flux density, accompanied with the change of the magnetic field strength, moves up the curve V to point a; and then switch 29 or TR open and switch 30 closed as well as I decreasing, the flux density moves down the curve II back to point Br. This illustrates that the core's magnetization phenomenon occurs only in the first quadrant, which means that the cores are not effectively utilized yet.

To overcome this drawback and make full use of the cores, a better choice is to have the inductor cores bi-polar and alternately magnetized. A use of push-pull inductor is a good idea to achieve this goal.

The use of push-pull inductor (see FIG. 11(*c*)) includes: ① One center-tapped inductor 28A or L3; two sets of electrically-symmetric driving switches or switching devices, such as transistors 31 and 33, each connected with a diode in series aiding or in reverse-parallel so as to avoid breakdown of p-n junctions of the driving switches [Note 1: Examples for "electrically-symmetric" are as those of driving switches, of passive switches, and of their driving signals etc in double-ended circuits, such as half-bridge, full-bridge and push-pull converters. Note 2: Suppose that the circuit herein belongs to positive logic and employs npn bipolar junction transistors (BJTs) though this application is not limited on positive logic nor to bipolar transistors employed only]; two sets of electrically-symmetric auxiliary switching devices, here supposed such as diodes 32 and 34; with the value and current rating of inductance 28A, and electrical specifications of the switches all determined by the requirements of design. ② One end of inductor 28A electrically connected to the collector of transistor 31 and also to the anode of switch 32, the other end of 28A connected to the collector of transistor 33 and also to the anode of switch 34; the emitters of transistors 31 and 33 connected together to the reference potential; the center-tap of inductor 28A connected to a high potential; the cathodes of switches 32 and 34 connected together to another appropriate high potential; the bases or control-input terminals of transistors 31 and 33 respectively connected to corresponding control-and-driving signals with two periods as a cycle, electrically-symmetrical to each other and alternately working such as $P_1$ and $P_2$. ③ The push-pull inductor employing a technique of bi-periodically time-shared driving as described as: switches 31 and 33 in FIG. 11(*c*) separately driven by the PWM control-and-drive signals as those like $P_1$ and $P_2$; although the total current, $I_A$ in FIG. 11(*c*), of the push-pull inductor may remain the same as I in FIG. 11(*b*), the magnetization mode of the cores of inductor 28A or L3 is changed (see FIG. 11(*e*)) as: during the steady-state operation of the circuit in FIG. 11(*c*), when only switch 31 or TR1 turned on, the core's magnetization locus goes up curve I from point −Br to point a; then switch 31 or TR1 turned off and diode 32 or D1 turned on while magnetizing down curve II from point a back to point Br till the end of the first period of the circuit operation; symmetrically, the second period starts when only switch 33 or TR2 turned on, the cores' magnetizing continuously moving down curve III from point Br to point b; thereafter, switch 33 or TR2 turned off and diode 34 or D2 turned on while the locus going up curve IV from point b back to point −Br till the end of the second period of the circuit operation, and also of one cycle of the bi-periodically time-shared driving [Note: Herein the working sequence of switches is described by investigating the cores' magnetization loci; it also can be described simply by stating the switch operations as: switch 33 keeping off for the first period while switch 31 being on no longer than T/2 before being turned off; for the second period switch 31 keeping off while switch 33 being on no longer than T/2 before being turned off, with the end of second period as the end of a cycle of the bi-periodically time-shared driving; where T is the time of switching period of the circuit].

In this example, the inductance value of inductor 28A in FIG. 11(*c*) may be equal to that of inductor 28 in FIG. 11(*b*). Inductor 28A may have two coils of the same turns number N as that for inductor 28, and smaller cores, and the two coils being wound bifilarly in parallel or separately in sections with a wire cross-sectional area of the 28A coils equal to half that of 28's before the wound twin coils connected series-aiding, with the connected point as the center-tap.

The technique of bi-periodically time-shared driving, in the utilization of push-pull on inductor, extends the cores' magnetization as widely as to all four quadrants, or full range of its magnetization characteristic, greatly upgrading its effectiveness, and with its size relatively decreased as well as the loss and cost accordingly declined. In addition, it eliminates problem of the cores' unsymmetrical magnetization phenomenon in conventional push-pull driving mode and greatly alleviates the cross-conductance of driving switches. Therefore, this technique, besides for driving a circuit of mutual capacitor or APFC, could also be exploited in driving some other double-ended circuits, such as bridge, half-bridge, or conventional push-pull transformer.

6. Explanations 6-1. Design Instructions of the LC Combined Transformer and General Rules for its Device Selections 1). The design of the LC combined transformer is substantially that of mutual capacitors, in which the first step is to study and digest the requirements of the design specifications and target, in particular of the errors, and then, in accordance with them to determine all the parameters of the mutual capacitors.

2). Every specialized error of voltage/current ratio of the LC combined transformer is the sum of those respectively accorded of all the contained subunits, mutual capacitors and mutual inductors; and the total error is the sum of all the specialized errors or of all the errors of all the subunits. It has been verified, in theory and by experiences, that the ratio errors of the LC combined transformer originate significantly from frequency swing and power dissipation, which particularly appears apparent while heavily loaded with a low equivalent load resistance for power transferring. Principal measures to decrease its errors include: stabilizing the frequency, operating at a higher frequency, modifying parameters of mutual capacitors to optimize error designed parameter expressions of all the mutual capacitor subunits, as well as using low loss materials and devices, etc.

3). Capacitors to be used should be with capacitance values as accurate as possible, with minimum temperature coefficients, minimum tg 6 values or satisfying specified design requirements, and with suitable voltage ratings.

4). Cores of inductors and mutual inductors of an LC combined transformer should be made of the same soft magnetic material with high magnetic permeability that exhibits evenly over the operating range, with low loss, and with high saturation flux density. The relative permeability $\mu_r$ of the cores should be equal to the mean value of the maximum relative permeability and the minimum relative permeability of inductors when working between 2% or 5% (in accordance with the needs or precision requirements) and 100% of their rated currents, i.e. $\mu_r=(\mu_{rmax}+\mu_{rmin})/2$. Linearization processing of the cores must meet the error requirements, as well as strictly control of the amounts of copper and iron used so as to realize the requested Q values by design.

5). Manufacture of a mutual inductor must come through models and experiments to obtain accurate design data, with the values of k, and of $L_1$ and $L_2$ as precise as possible.

6). Adjustments and tests of the LC combined transformer should be separately based on its mutual capacitor subunits. Due to the deviations of component parameters, mutual capacitors must be adjusted and tested within rated load ranges, in line with the principle of input and output voltages/currents in-phased, and measure the errors.

7). The design instructions and key points herein or included in this description state only those particular related to this invention, while the conventional methods omitted.

6-2. Formulas for Linerization Processing of Inductors and Mutual-Inductors

1). Determine the product, $SS_c$, of the core's cross-sectional area and window area: For an inductor, $$SS_c \geq \frac{\sqrt{2}\,LI_h^2}{B_h j} \times 10^{-6}(m^4) \text{ or } (\times 10^2 \text{cm}^4) \tag{84}$$

where,

S - - - core's cross-sectional area ($m^2$, in general, S=0.95× area measured in practice);

S - - - effective core's window area ($m^2$, S=K×area measured in practice, window utilization coefficient K≈0.7~0.9);

L - - - inductor's inductance value (H);

$I_h$ - - - rms value of the current at highest operating point in the winding (A);

$B_h$ - - - flux density at highest operating point of the basic magnetization curve (T);

j - - - current density for coil copper wire (A/mm$^2$ or $\times 10^6$ A/m$^2$);

For an mutual inductor, $$SS_c \geq \sqrt{2\left[1+\left(\frac{I_z}{2I_p}\right)^2\right]} \cdot \frac{P}{\pi f B_h j} \ (\times 10^{-6} m^4) \text{ or } (\times 10^2 \text{cm}^4) \tag{85}$$

where, $I_z$ - - - rms value of the magnetizing current of the winding (A);

$I_p$ - - - rms value of the real-power current of the winding (A);

P - - - power transferred through mutual inductor (W);

f - - - sinusoidal frequency in operation (Hz).

2). Determine the coil turns number N, and the copper wire's diameter d:

$$N \geq \frac{\sqrt{2}\,LI_h}{B_h S} \tag{86}$$

where N - - - coil turns number;

for an mutual inductor, $I_h=I_z$; or by $$N = \frac{V}{\sqrt{2}\,\pi f B_h S} \tag{87}$$

where V - - - rms voltage of the winding (V). And $$d = 2\sqrt{\frac{I_h}{\pi j}} \approx 1.13\sqrt{\frac{I_h}{j}} \ \text{(mm)} \tag{88}$$

where $$I_h = \sqrt{I_p^2 + I_z^2}$$

when for an mutual inductor;

with an assumption of a copper wire $d_1 \geq d$, check effectiveness of the window area.

3). Determine the core's air-gap length $l_g$, equivalent relative permeability $\mu_r$; and check the inductance L:

$$l_g = \frac{\mu_o\left(\sqrt{2}\,NI_h - H_h l_F\right)}{B_h} \tag{89}$$

where, $l_g$ - - - air-gap length (m);

$l_F$ - - - mean length of the core's magnetic circuit (m);

$H_h$ - - - magnetic field strength at highest operating point of the basic magnetization curve (A/m); and $$\mu_{r'} = \frac{\mu_r l_F}{\mu_r l_g + l_F} \tag{90}$$

$$L = \frac{\mu_{r'}\mu_o N^2 S}{l_F} \tag{91}$$

6-3. Functions of Waveform Conversion from Square to Quasi-Sine of the Mutual Capacitor (Continue)

Functions of waveform conversion from square to quasi-sine of the LC combined transformer are actually those of the mutual capacitors. Following the detailed discussion of waveform conversion of in-phased mode voltage transformation type LC combined transformer given in previous description, as a supplement, here presents the corresponding discussion for that of the anti-phased mode voltage transformation type LC combined transformer, and an analysis of that of the current transformation-A type LC combined transformer as well.

The first mutual capacitor, consisting of 1, 2 and 3, of the anti-phased mode voltage transformation type LC combined transformer in FIG. 6(*a*) also possesses the characteristic of waveform conversion from square to quasi-sine, explained with an expression resulted from Eqs. (45) to (47), when a $v_1(t)$ of Eq. (81) supplying across its input port, as $$|V_{xm}| = \frac{|V_{1m}|}{\sqrt{[1-m^2(1-n_{v1})]^2+\left[m(1-m^2)\left(\frac{1}{n_{v1}}-1\right)^2\left(\frac{1}{\omega C_m R_1}\right)\right]^2}} \text{ or as} \tag{92}$$

$$\left|\frac{V_{xm}}{V_{x1}}\right| = \left|\frac{V_{1m}}{V_{11}}\right| \cdot \frac{|n_{v1}|}{\sqrt{[1-m^2(1-n_{v1})]^2+\left[m(1-m^2)\left(\frac{1}{n_{v1}}-1\right)^2\left(\frac{1}{\omega C_m R_1}\right)\right]^2}} = \frac{1}{m}\cdot\frac{|n_{v1}|}{\sqrt{[1-m^2(1-n_{v1})]^2+\left[m(1-m^2)\left(\frac{1}{n_{v1}}-1\right)^2\left(\frac{1}{\omega C_m R_1}\right)\right]^2}} \tag{93}$$

Design Considerations: By listing the data of $|V_{xm}/V_{x1}|$ calculated from this equation with different values of $n_{v1}$ and $(\omega C_m R_1)$ of the mutual capacitor, conclusions could be drawn as: This mutual capacitor owns a much better characteristic of voltage waveform conversion than that of in-phase mode except at a point $n_{v1}=1$; the farther away from the point of $n_{v1}=1$, the better the characteristic is; and with a heavier load, and a more optimum characteristic will achieve; in addition, its voltage ratio ranges either greater or less than one. However, it is also found from Eqs. (48) to (51) that the ratio error of the mutual capacitor turns worse as its load goes heavier. Therefore, to increase the load capacity, it is necessary to make every effort either to increase the capacitance $C_m$, or to make the frequency ω higher, or to enhance the $n_{v1}$, or to have a good balance among the three so as to achieve the goal of a satisfying waveform conversion together with minimum errors.

The mutual capacitor of the current transformation-A type LC combined transformer in FIG. 3 has a characteristic of current waveform conversion from square to quasi-sine. If I in FIG. 3(*a*), replaced with a current source i(t) of a waveform identical to Eq. (81), Eqs. (8) to (10) may be mathematically deduced to the following $$I_{2m} = \frac{I_m}{n_c\cdot\sqrt{1+\left[k\omega C_m R\left(\frac{1}{m}-m\right)\right]^2}} \tag{94}$$

$$\left|\frac{I_{2m}}{I_{21}}\right| = \left|\frac{I_m}{I_1}\right|\cdot\frac{1}{\sqrt{1+\left[k\omega C_m R\left(\frac{1}{m}-m\right)\right]^2}} = \frac{1}{m\cdot\sqrt{1+\left[k\omega C_m R\left(\frac{1}{m}-m\right)\right]^2}} \propto \frac{\Gamma}{m^2} \tag{95}$$

where, Γ is a certain limited positive value. The final expression ∝ of this equation means that, when m larger than that limited value, the value of $$\left|\frac{I_{2m}}{I_{21}}\right|$$

is roughly inversely proportional to the square of m, which obviously demonstrates this mutual capacitor having a function of current waveform conversion from square to quasi-sine. As a matter of fact, suppose that the mutual capacitor is used from the opposite direction, i.e. the input and output ports switched to each other, its function of current waveform conversion will be much better; which could be soundly explained through an observation that the delta (Δ) mutual capacitor of this inversely-directional application is actually the dual of the first tee (T) mutual capacitor in FIG. 5(*a*) [Note: Refer to FIG. 12-8 in "6-4. Principle of the Mutual Capacitor"]. Current waveform conversion from square to quasi-sine will be very significant for utility networks, which will contribute to better rectifier transformers.

6-4. Principle of the Mutual Capacitor

1). Definition of the Mutual Capacitor

Definition: A mutual capacitor is a two-port network element with no power loss and coupled by electric field between ports of input and output.

Figure 1:
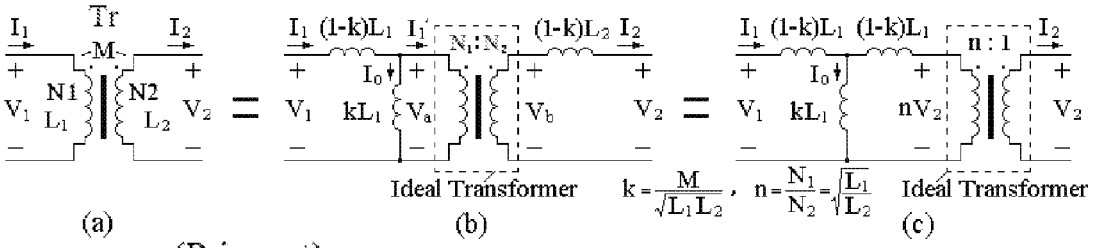
(Prior art) Fig. 1
FIG. 1 (prior art) is (a) a schematic circuit symbol of a mutual inductor (or conventional transformer) and (b) or (c) is its equivalent circuit diagram expressed by using an ideal transformer.

FIGS. 12-1 and 12-2 are schematic symbols or circuit models of two types of the mutual capacitor, in which the position of circles or dots, represents the polarity notation of the port voltages, and circles or dots also mean types different from each other.

The first pair of definition equations of the mutual capacitors is differentially expressed as Eq. (96), wherein they are presented by port currents, so as to be termed the current type of mutual capacitor. FIG. 12-3 illustrates the simplest circuit configurations of the current type of mutual capacitor, also referred to as the delta (Δ) (or pi (π) mutual capacitor. The first-step expressions of Eq. (96) are the dual of differential forms of Eqs. (1) & (2); and its second-step ones are written from FIG. 12-3(*a*).

$$\begin{cases} i_1 = C_I\frac{dv_1}{dt} - C_M\frac{dv_2}{dt} = (C_A+C_M)\frac{dv_1}{dt} - C_M\frac{dv_2}{dt} \\ i_2 = -C_m\frac{dv_1}{dt} + C_{II}\frac{dv_2}{dt} = -C_M\frac{dv_1}{dt} + (C_B+C_M)\frac{dv_2}{dt} \end{cases} \tag{96}$$

Where, being the arguments, the structural parameters $C_A$, $C_B$, $C_M$ can exist all over the three dimensional space, i.e. $\{|C_A|<\infty, |C_B|<\infty, |C_M|<\infty\}$. $C_I$ and $C_{II}$ are termed the self-capacitance coefficients, and $C_M$ termed the mutual-capacitance coefficient of the current type mutual capacitor; and they are respectively defined in the following, $$i_1 = C_I\frac{dv_1}{dt}\Big|_{v_2=const.} \tag{97}$$

$$i_2 = C_{II}\frac{dv_2}{dt}\Big|_{v_1=const.} \tag{98}$$

$$\begin{cases} i_1 = -C_M\frac{dv_2}{dt}\Big|_{v_1=const.} \\ i_2 = C_M\frac{dv_1}{dt}\Big|_{v_2=const.} \end{cases} \tag{99}$$

Obviously there are $$C_I = C_A + C_M \tag{100}$$

$$C_{II} = C_B + C_M \tag{101}$$

The coupling coefficient of the current type mutual capacitor is defined as $$k_c = \frac{C_M}{\sqrt{C_I C_{II}}} \tag{102}$$

with having $|k_c|=1$ known as the current type mutual capacitor unity-coupled or in unity coupling, i.e. fully-coupled or in full coupling.

The second pair of definition equations of the mutual capacitor is integrally expressed as Eq. (103), wherein they are presented by port voltages, so as to be termed the voltage type of mutual capacitors. FIG. 12-4 illustrates the simplest circuit configurations of the voltage type of mutual capacitors, also referred to as the tee (T) (or wye (Y) mutual capacitor. The first-step expressions of Eq. (103) are dual from differential forms of Eq. (96); and its second-step ones come from FIG. 12-4(*a*).

$$\begin{cases} v_1 = \frac{1}{C_1}\int i_1 dt + \frac{1}{C_m}\int i_2 dt = \left(\frac{1}{C_a} + \frac{1}{C_m}\right)\int i_1 dt + \frac{1}{C_m}\int i_2 dt \\ v_2 = \frac{1}{C_m}\int i_1 dt + \frac{1}{C_2}\int i_2 dt = \frac{1}{C_m}\int i_1 dt + \left(\frac{1}{C_b} + \frac{1}{C_m}\right)\int i_2 dt \end{cases} \tag{103}$$

Where, being the arguments, the structural parameters $C_a$, $C_b$, $C_m$ can exist in three dimensional space but not all, i.e. $\{C_a \neq 0, C_b \neq 0, C_m \neq 0\}$. $C_1$ and $C_2$ are termed the self-capacitance coefficients, and $C_m$ termed the mutual-capacitance coefficient of the voltage type mutual capacitor; and they are respectively defined in the following, $$v_1 = \frac{1}{C_1}\int i_1 dt\Big|_{i_2=0} \tag{104}$$

$$v_2 = \frac{1}{C_2}\int i_2 dt\Big|_{i_1=0} \tag{105}$$

$$\begin{cases} v_1 = \frac{1}{C_m}\int i_2 dt\Big|_{i_1=0} \\ v_2 = \frac{1}{C_m}\int i_1 dt\Big|_{i_2=0} \end{cases} \tag{106}$$

Obviously there are $$C_1 = \frac{C_a C_m}{C_a + C_m} = C_a \perp C_m \tag{107}$$

$$C_2 = \frac{C_b C_m}{C_b + C_m} = C_b \perp C_m \tag{108}$$

The coupling coefficient of the voltage type mutual capacitor is defined as $$k_v = \frac{C_m}{\sqrt{C_1 C_2}} \tag{109}$$

with having $|k_v|=1$ known as the voltage type mutual capacitor unity-coupled or in unity coupling, i.e. fully-coupled or in full coupling.

It must be pointed out that, though both the denomination and the definition of mutual capacitors are described with capacitances, they are mostly implemented with capacitors as well as inductors, for, at a constant frequency ω, positive inductance functions exactly as a negative capacitance, namely $$C = -\frac{1}{\omega^2 L}.$$

[Note: Even though the arrangement of three inductors is in a delta (Δ) (or pi (π)) configuration, it is a mutual capacitor, other than a mutual inductor unless there exists magnetic coupling between ports.] Besides, for electronic circuits, a negative capacitance can be realized through a negative impedance converter (NIC) of integrated circuits; in terms of which a mutual capacitor constituted operates theoretically at any frequency; see the prior art in FIG. 12-9. Sometimes, a mutual capacitor may be called a capacitive transformer or C-transformer as well, and mutual inductor called an inductive transformer or L-transformer.

2). The Unity-Coupled Mutual Capacitors (1). Prerequisite of Unity Coupling of the Current Type Mutual Capacitor and its Current Transformation Characteristic For the current type mutual capacitor illustrated in FIGS. 12-1 and 12-3, suppose it be unity-coupled or $|k_c|=1$, from Eqs. (100), (101) and (102), obtain its unity coupling prerequisite as $$\frac{1}{C_A} + \frac{1}{C_B} + \frac{1}{C_M} = 0 \tag{110}$$

In a sense of being unity-coupled, its definition equations Eq. (96) will be derived to as $$\begin{cases} i_1 = \frac{C_A}{C_A + C_B}\left(C_A \frac{dv_1}{dt} + C_B \frac{dv_2}{dt}\right) \\ i_2 = \frac{C_B}{C_A + C_B}\left(C_A \frac{dv_1}{dt} + C_B \frac{dv_2}{dt}\right) \end{cases} \tag{111}$$

Note that the algebraic sum of derivatives in above parentheses is not zero, for $$C_A \frac{dv_1}{dt} + C_B \frac{dv_2}{dt} = i_{CA} + i_{CB} \neq 0,$$

meaning physically that the net current flowing into reference potential keeps not being zero [Note: According to its geometrical symmetry of structure, it means that the current type mutual capacitor cannot be designed as a current transformer having a current ratio of −1]. If this retains true, a unity-coupled current type mutual capacitor will have its current transforming ratio between ports as $$n_c = \frac{i_1}{i_2} = \frac{C_A}{C_B} = \mathrm{sgn}(C_A C_B)\sqrt{\frac{C_I}{C_{II}}} \tag{112}$$

It also be called the ratio of the unity-coupled current type mutual capacitor. Eq. (112) indicates that this ratio is set up only when it is unity-coupled, and it is determined only by its structural parameters $C_A$ and $C_B$, independent of its operating frequency and its load across output port. It should be pointed out that the ratio of the current type mutual capacitor has a practical significance.

(2). Prerequisite of Unity Coupling of the Voltage Type Mutual Capacitor and its Voltage Transformation Characteristic For the voltage type mutual capacitor illustrated in FIGS. 12-2 and 12-4, suppose it be unity-coupled or $|k_v|=1$. From Eqs. (107), (108) and (109), obtain its unity coupling prerequisite as $$C_a+C_b+C_m=0 \tag{113}$$

In a sense of being unity-coupled, its definition equations Eq. (103) will be derived to as $$\begin{cases} v_1 = \dfrac{1}{C_a(C_a+C_b)}\left(C_b\displaystyle\int i_1 dt - C_a\int i_2 dt\right) \\ v_2 = -\dfrac{1}{C_b(C_a+C_b)}\left(C_b\displaystyle\int i_1 dt - C_a\int i_2 dt\right) \end{cases} \tag{114}$$

Assume that the algebraic sum of integrals in above parentheses is not zero, i.e.

$$\frac{1}{C_a}\int i_1 dt \neq \frac{1}{C_b}\int i_2 dt,$$

meaning physically to keep it true as $v_{Ca}\neq v_{Cb}$ [Note: According to its geometrical symmetry of structure, it means that the voltage type mutual capacitor cannot be designed as a voltage transformer having a voltage ratio of 1]. If this retains true, a unity-coupled voltage type mutual capacitor will have its voltage transforming ratio between ports as $$n_v = \frac{v_1}{v_2} = -\frac{C_b}{C_a} = -\mathrm{sgn}(C_aC_b)\sqrt{\frac{C_2}{C_1}} \tag{115}$$

It also be called the ratio of the unity-coupled voltage type mutual capacitor. Eq. (115) indicates that this ratio is set up only when it is unity-coupled, and it is determined only by its structural parameters $C_a$ and $C_b$, independent of its operating frequency and its load across output port. It should be pointed out that the ratio of the voltage type mutual capacitor has a practical significance.

(3). Equivalent Circuits of Unity-Coupled Mutual Capacitors Expressed with Controlled Sources First, let's look at the current type mutual capacitor. Assuming the current flowing through the coupling capacitance $C_M$ in FIG. 12-3 as i (in a direction to $V_2$), we have $$\begin{aligned} v_1 &= \frac{1}{C_A}\int (i_1 - i)dt \\ &= \frac{1}{C_A}\int (i_1+i_2)dt - \frac{C_B}{C_A}\cdot\frac{1}{C_B}\int (i+i_2)dt \\ &= \frac{1}{C_A}\int\left[i_1\left(1+\frac{1}{n_c}\right)\right]dt - \frac{C_B}{C_A}v_2 \end{aligned} \tag{116}$$

-continued $$= \frac{1}{\left(\frac{n_c}{n_c+1}\right)C_A}\int i_1 dt - \frac{1}{n_c}v_2$$

If making $$C_S = \left(\frac{n_c}{n_c+1}\right)C_A \tag{117}$$

from Eqs. (112), (116) and (117), a controlled-source equivalent circuit for unity-coupled current type mutual capacitor is set as in FIG. 12-5(*a*).

Next, we discuss the voltage type mutual capacitor. Assuming the voltage across the coupling capacitance $C_m$ as v, shown as in FIG. 12-4, we have $$\begin{aligned} i_1 &= C_a\frac{d}{dt}(v_1 - v) \\ &= C_a\frac{d}{dt}(v_1 - v_2) + \frac{C_a}{C_b}\cdot C_b\frac{d}{dt}(v_2 - v) \\ &= C_a\frac{d}{dt}\left[v_1\left(1-\frac{1}{n_v}\right)\right] + \frac{C_a}{C_b}i_2 \\ &= \left(1-\frac{1}{n_v}\right)C_a\frac{d}{dt}v_1 - \frac{1}{n_v}i_2 \end{aligned} \tag{118}$$

If making $$C_P = \left(1-\frac{1}{n_v}\right)C_a \tag{119}$$

from Eqs. (115), (118) and (119), a controlled-source equivalent circuit for unity-coupled voltage type mutual capacitor is set as in FIG. 12-5(*b*).

(4). Ideal Mutual Capacitors

If we are drawing out for further abstract from the unity-coupled current type mutual capacitor shown in FIG. 12-3, letting $C_A\rightarrow+\infty$, $C_B\rightarrow+\infty$, and meanwhile $C_M\rightarrow-\infty$ (restricted by Eq. (110), and assuming the limit of ratio of $(C_A/C_B)$ existing, we have the ratio of Eq. (96), or $(i_1/i_2)$, approaching its limit in a result as Eq. (112), that is $$\lim_{\substack{C_A\rightarrow+\infty \\ C_B\rightarrow+\infty}} \frac{i_1}{i_2} = \lim_{\substack{C_A\rightarrow+\infty \\ C_B\rightarrow+\infty}}\left(\frac{C_A}{C_B}\right) = n_c \tag{120}$$

while Eq. (116) being evolved as $$\lim_{\substack{C_A\rightarrow+\infty \\ C_B\rightarrow+\infty}} v_1 = \frac{1}{n_c}v_2 \tag{121}$$

meaning the port relations present the simplest descriptions, shortly as $$\begin{cases} i_1 = n_c i_2 \\ v_1 = \frac{1}{n_c} v_2 \end{cases} \quad (122)$$

Also, we do the same thing for the unity-coupled voltage type mutual capacitor shown in FIG. 12-4, letting $C_a \to +0$, $C_b \to +0$, and meanwhile $C_m \to -0$ (restricted by Eq. (113), and assuming the limit of ratio of $(C_a/C_b)$ existing, we have the ratio of Eq. (103), or $(v_1/v_2)$, approaching its limit in a result still the same as Eq. (115), that is $$\lim_{\substack{C_a \to +0 \\ C_b \to +0}} \frac{v_1}{v_2} = \lim_{\substack{C_a \to +0 \\ C_b \to +0}} \left(-\frac{C_b}{C_a}\right) = n_v \quad (123)$$

while Eq. (118) being evolved as $$\lim_{\substack{C_a \to +0 \\ C_b \to +0}} i_1 = \frac{1}{n_v} i_2 \quad (124)$$

meaning the port relations also present the simplest descriptions, shortly as $$\begin{cases} v_1 = n_v v_2 \\ i_1 = \frac{1}{n_v} i_2 \end{cases} \quad (125)$$

Making a comparison between above two pairs of equations concluded in short, of Eq. (122) and Eq. (125), indicates that they both have the same mathematical equations, just with a reciprocal ratio from each other. Thus, provided that we ignore some difference between properties (of types, current and voltage), and stress their sameness in mathematics and commonness in physics (having the same mathematical equations and belonging to common capacitive two-port network elements coupled by electric field), present one in between that can represent them both with just one two-port network element, i.e. the ideal mutual capacitor, as well as its mathematical equations and the model of network element.

The mathematical port equations of the ideal mutual capacitor are given as $$\begin{cases} i_1 = n i_2 \\ v_1 = \frac{1}{n} v_2 \end{cases} \quad (126)$$

and its schematic symbols or circuit models given as in FIG. 12-6. Attention should be paid with FIG. 12-6, in which what the polarity notation looks like still can denote its type, with the symbol in FIG. 12-6(*a*) corresponding to Eq. (126) when $n=n=n_c$, and with the symbol in FIG. 12-6(*b*) also corresponding to Eq. (126) when $n=1/n_v$.

FIG. 12-7 illustrates the equivalent circuits of unity-coupled mutual capacitors, by employing ideal mutual capacitors, another way to clarify or replace those in FIG. 12-5. P 3). The Mutual Capacitor and the Duality Principle for Electric Networks Like vehicle is a species of transportation means, vessel is another one. More closely, like the conventional transformer is a species of AC transformer, the LC combined transformer is another species, in which the unity-coupled mutual capacitor is almost exactly dual to the unity-coupled mutual inductor excepting the dc-blocking property, appearance in integration and independence on frequency for power use.

Introduction of the mutual capacitor will complement and consummate the principle of duality for electric networks, and also help it to be more effectively applied into practice. An example for making the dual of a circuit including a coupling component is shown as in FIG. 12-8.

FIG. 12-8(*b*) illustrates an approach on how to dualize or make the dual of a network with a coupling component, being termed the branch-dualizing rule, which is briefly stated as follows: Treating every circuit element of a network as a branch or as two branches in a case of two-port element, imaginarily rotating each branch to be perpendicular to its primary yields its dual branch; any mesh, including the outer one, of the network must correspond to and produce only one node for the dual network; and the dual branch will have its current direction determined as well as its element physical property switched as:

① by 90° counterclockwise turning its primary if it has a current-voltage direction relationship in accordance with the passive sign convention [Note: It's a convention that a branch's current just enters the "+" end of its voltage], and doing a dual substitution in physical property such as [Note: "<=>" means "dual to each other"]:

resistance<=>conductance; primary of mutual inductor<=>primary of mutual capacitor;

inductance<=>capacitance; driving switch off<=>driving switch on. Or,

② by 90° clockwise turning its primary if it has a current-voltage direction relationship which is not in accordance with the passive sign convention, and by doing a dual substitution in physical property such as:

current source<=>voltage source; passive switch on<=>passive switch off; secondary of mutual inductor<=>secondary of mutual capacitor.

[Note: Examples of switch categories: driving switch—transistor; passive switch—diode].

What is claimed is:

1. A species of electric transformer, termed LC combined transformer, used for transferring electric signal or energy of periodic sine wave, and proportionally altering the amplitude(s)/magnitude(s) of current or/and voltage of the periodic sine wave between input and output ports when neglecting power loss, being a current type unity-coupled mutual capacitor characterized as current transformation, or a voltage type unity-coupled mutual capacitor characterized as voltage transformation, or a circuit of LC combined transformer in cascade connection of an ideal transformer plus one current type unity-coupled mutual capacitor or two voltage type unity-coupled mutual capacitors, comprising said current type unity-coupled mutual capacitor consisting of three linear capacitances in delta (Δ) configuration with a sum of the reciprocals of said three capacitances being zero;

said voltage type unity-coupled mutual capacitor consisting of three linear capacitances in wye (Y) configuration with a sum of said three capacitances being zero;

either of said unity-coupled mutual capacitors including negative capacitance(s) which may be realized through negative impedance converter(s) (NIC) or by employing linear inductor(s) when operating at a constant frequency;

said circuit of LC combined transformer comprising current transformation-A type LC combined transformer consisting of a mutual inductor (Tr), an inductor (Lb) and a capacitor (Cm), if designating the primary winding terminals of said mutual inductor (Tr) as the input port of said current transformation-A type LC combined transformer, said mutual inductor (Tr)'s secondary winding and said inductor (Lb) and said capacitor (Cm) being connected in series to form a closed loop before designating the two terminals of said capacitor (Cm) as the output port; said current transformation-A type LC combined transformer presenting a ratio of current transformation between ports as $$\frac{I_1}{I_2} = \frac{1}{nk}\left(1 + \frac{L_b}{L_2}\right)$$

under the prerequisite of the parameters satisfying $\omega^2 C_m(L_2+L_b)=1$;

said circuit of LC combined transformer comprising current transformation-B type LC combined transformer consisting of a mutual inductor (Tr) and two capacitors (Cb) and (Cm), if designating the primary winding terminals of said mutual inductor (Tr) as the input port of said current transformation-B type LC combined transformer, said mutual inductor (Tr)'s secondary winding and said capacitors (Cb) and (Cm) being connected in series to form a closed loop before designating the two terminals of said capacitor (Cm) as the output port; said current transformation-B type LC combined transformer presenting a ratio of current transformation between ports as $$\frac{I_1}{I_2} = \frac{C_b}{nk(C_b + C_m)}$$

under the prerequisite of the parameters satisfying $$\omega^2 L_2\left(\frac{C_b C_m}{C_b + C_m}\right) = 1;$$

said circuit of LC combined transformer comprising in-phase mode voltage transformation type LC combined transformer consisting of a mutual inductor (Tr), an inductor (La), and two capacitors (Cb) and (Cm), if taking one end of said inductor (La) as the input terminal, the other end is connected with one end of said capacitor (Cb) and also one end of said capacitor (Cm), the other end of said capacitor (Cb) connected to one terminal of the primary winding of said mutual inductor (Tr), the other end of said capacitor (Cm) connected to the other terminal of said primary winding with this joint taken as the common terminal, then designating said input terminal and said common terminal as the input port of said in-phase mode voltage transformation type LC combined transformer, as well as designating the two terminals of the secondary winding of said mutual inductor (Tr) as the output port; said in-phase mode voltage transformation type LC combined transformer presenting a ratio of voltage transformation between ports as $$\frac{V_1}{V_2} = \frac{knC_{b1}}{C_{b1} + C_m}$$

under the prerequisite of its parameters satisfying $\omega^2 L_a(C_{b1}+C_m)=1$ and $\omega^2(1-k^2)L_1 C_{b2}=1$;

said circuit of LC combined transformer comprising anti-phase mode voltage transformation type LC combined transformer consisting of a mutual inductor (Tr), two inductors (La) and (Lb), and two capacitors (Cb) and (Cm), if taking one end of said inductor (La) as the input terminal, the other end is connected with one end of said inductor (Lb) and also one end of said capacitor (Cm), the other end of said inductor (Lb) connected to one end of said capacitor (Cb), the other end of said capacitor (Cb) connected to one terminal of the primary winding of said mutual inductor (Tr), the other end of said capacitor (Cm) connected to the other terminal of said primary winding with this joint taken as the common terminal, then designating said input terminal and said common terminal as the input port of said anti-phase mode voltage transformation type LC combined transformer, as well as designating the two terminals of the secondary winding of said mutual inductor (Tr) as the output port; said anti-phase mode voltage transformation type LC combined transformer presenting a ratio of voltage transformation between ports as $$\frac{V_1}{V_2} = -kn\frac{L_a}{L_b}$$

under the prerequisite of its parameters satisfying $$\omega^2 C_m\left(\frac{L_a L_b}{L_a + L_b}\right) = 1$$

and $\omega^2(1-k^2)L_1 C_b=1$;

for all above formulas where ($I_1$) and ($I_2$) respectively represent the sinusoidal currents of entering said input port and leaving said output port, ($V_1$) and ($V_2$) respectively represent the sinusoidal voltages across said input and output ports, ($L_1$) and ($L_2$) respectively are the self-inductances of primary and secondary windings of said mutual inductor (Tr), (k) and (n) respectively are the coupling coefficient and turns ratio of said mutual inductor (Tr), ($L_a$) and ($L_b$) respectively represent corresponding inductances of said inductors (La) and (Lb), ($C_b$) and ($C_m$) respectively represent corresponding capacitances of said capacitors (Cb) and (Cm), ($C_{b1}$) and ($C_{b2}$) respectively represent the first and the second of two series-equivalent components of said capacitance ($C_b$) or $$C_b = \frac{C_{b1} C_{b2}}{C_{b1} + C_{b2}},$$

and ($\omega$) is the electric angular frequency of the periodic sine wave applied to this transformer.

2. The electric transformer according to claim 1, wherein the inductor (Lb) and the mutual inductor (Tr) may be linearly integrated into an integrated inductor and mutual inductor, comprising:

the core magnetic circuit (F1) of said mutual inductor (Tr), the core magnetic circuit (F2) of said inductor (Lb), the first winding (N1) of said mutual inductor (Tr), the two-in-one common coil (N2) serving both as the second winding of said mutual inductor (Tr) and also as the winding of said inductor (Lb), and the auxiliary winding (ΔN) (set when needed) of (Lb), being structurally built as that said first winding (N1) is just wound around said core magnetic circuit (F1) with its terminals designated as one port of said integrated inductor and mutual inductor, said two-in-one common coil (N2) wound around the paralleled and adjacent-to-each-other portions of both said core magnetic circuits (F1) and (F2), said auxiliary winding (ΔN) just wound around said core magnetic circuit (F2), plus said two-in-one common coil (N2) and said auxiliary winding (ΔN) connected in series-aiding with their terminals after series designated as the other port, with a result that the turns ratio (n), the coupling coefficient (k), the self-inductances ($L_1$) and ($L_2$) respectively of said windings (N1) and (N2), and relationships of currents and powers of said mutual inductor (Tr) will all remain unchanged as those of its original mutual inductor without being integrated, the inductance ($L_b$) of said inductor ($L_b$) will be determined by said core magnetic circuit (F2) and said winding (N2+ΔN) as that of a normal inductor, except that the total inductance of said other port of this integrated inductor and mutual inductor will be the sum of said inductances ($L_2$) and ($L_b$) when both said core magnetic circuits are linear.

3. The electric transformer according to claim 1, wherein the inductor (La) may be a center-tapped inductor, thus being termed a use of push-pull inductor, including:

① the center-tapped inductor, two electrically-symmetric switching devices such as power bipolar junction transistors (BJTs) - - - each with a diode connected in series-aiding or in reverse-parallel for a purpose of protection, and two electrically-symmetric auxiliary switching devices such as diodes;

② being constructed as that the center-tap of said inductor is electrically connected to a high potential, one end of said inductor connected to collector of the first BJT and also to anode of the first diode, the other end of said inductor connected to collector of the second BJT as well as to anode of the second diode, emitters of both BJTs connected together to the reference potential, cathodes of both diodes connected together to another appropriate high potential, and bases of both BJTs respectively connected to corresponding control-and-drive signals;

③ and employing a technique of bi-periodically time-shared driving to drive the push-pull inductor.

4. The use of push-pull inductor according to claim 3, wherein the technique of bi-periodically time-shared driving is described as:

a pulse-width modulation (PWM) control and drive with two switching periods being a cycle of a sequence, stated as follows:

for the first period the second switching device keeping OFF while the first switching device being ON no longer than T/2 before being turned off; for the second period the first switching device keeping OFF while the second switching device being ON no longer than T/2 before being turned off, with the end of the second period as the end of a cycle of the bi-periodically time-shared driving; where T is the time interval of switching period of the circuit.

* * * * *